US011521549B2

(12) United States Patent
Kuang et al.

(10) Patent No.: US 11,521,549 B2
(45) Date of Patent: Dec. 6, 2022

(54) PIXEL DRIVING CIRCUIT, METHOD FOR DRIVING THE SAME, AND DISPLAY PANEL

(71) Applicants: WUHAN TIANMA MICROELECTRONICS CO., LTD., Wuhan (CN); Wuhan Tianma Microelectronics Co., Ltd. Shanghai Branch, Shanghai (CN)

(72) Inventors: Jian Kuang, Wuhan (CN); Mengmeng Zhang, Wuhan (CN); Xingyao Zhou, Wuhan (CN); Lilian Kuang, Shanghai (CN)

(73) Assignees: WUHAN TIANMA MICROELECTRONICS CO., LTD, Wuhan (CN); Wuhan Tianma Microelectronics Co., Ltd. Shanghai Branch

( * ) Notice: Subject to any disclaimer, the term of this patent is extended or adjusted under 35 U.S.C. 154(b) by 0 days.

(21) Appl. No.: 17/834,499

(22) Filed: Jun. 7, 2022

(65) Prior Publication Data

US 2022/0301507 A1 Sep. 22, 2022

(30) Foreign Application Priority Data

Feb. 21, 2022 (CN) ..... 202210155935.1

(51) Int. Cl.
*G09G 3/3233* (2016.01)
*G09G 3/3291* (2016.01)
*G09G 3/3266* (2016.01)

(52) U.S. Cl.
CPC ..... *G09G 3/3233* (2013.01); *G09G 3/3266* (2013.01); *G09G 3/3291* (2013.01); (Continued)

(58) Field of Classification Search
CPC ..... G09G 3/3233; G09G 2300/0819; G09G 2320/043; G09G 2320/0233; G09G 2320/045
See application file for complete search history.

(56) References Cited

U.S. PATENT DOCUMENTS

2009/0225013 A1* 9/2009 Lee ..... G09G 3/3233 345/80
2011/0102403 A1* 5/2011 Kim ..... G09G 3/3233 345/76

(Continued)

FOREIGN PATENT DOCUMENTS

CN 112562593 A 3/2021
CN 113012643 A 6/2021

*Primary Examiner* — Dong Hui Liang
(74) *Attorney, Agent, or Firm* — Christensen O'Connor Johnson Kindness PLLC

(57) ABSTRACT

A pixel driving circuit, a method for driving the same, and a display panel are provided. An operating sequence of the pixel driving circuit includes a first light-emitting stage and a second light-emitting stage after the first light-emitting stage. The first light-emitting stage includes a data writing stage and a light-emitting stage after the data writing stage. The second light-emitting stage includes a correcting stage and a light-emitting stage after the correcting stage. The pixel driving circuit includes a driving module, a threshold voltage capturing module configured to be turned on during the data writing stage and to write a data voltage to a control terminal of the driving module, and a coupling module configured to adjust a coupling voltage of the control terminal of the driving module during the correcting stage and the light-emitting stage of the second light-emitting stage.

32 Claims, 16 Drawing Sheets

(52) U.S. Cl.
CPC ..... *G09G 2300/0426* (2013.01); *G09G 2300/0852* (2013.01); *G09G 2310/061* (2013.01)

(56) References Cited

U.S. PATENT DOCUMENTS

| | | | | |
|---|---|---|---|---|
| 2011/0193855 | A1* | 8/2011 | Han | G09G 3/3266 345/76 |
| 2019/0295470 | A1* | 9/2019 | Kim | G09G 3/3258 |
| 2020/0365074 | A1* | 11/2020 | Hashimoto | G09G 3/32 |
| 2022/0101779 | A1* | 3/2022 | Liu | G09G 3/3233 |

* cited by examiner

PIXEL DRIVING CIRCUIT, METHOD FOR DRIVING THE SAME, AND DISPLAY PANEL

CROSS-REFERENCE TO RELATED APPLICATION

The present application claims priority to Chinese Patent Application No. 202210155935.1, filed on Feb. 21, 2022, the content of which is incorporated herein by reference in its entirety.

TECHNICAL FIELD

The present disclosure relates to the field of display technologies, and, particularly, relates to a pixel driving circuit, a method for driving a pixel driving circuit, and a display panel.

BACKGROUND

An organic light-emitting diode (OLED) display panel has advantages of low power consumption, self-luminescence, wide viewing angle, wide temperature characteristics, and fast response speed, and is widely applied in the market. A pixel driving circuit configured to control a light-emitting device to emit light is important for the OLED display panel, which has important research significance.

In a pixel driving circuit in the related art, due to operating characteristics of the driving transistors, there is a brightness difference between resetting light-emitting and maintaining light-emitting of the display panel, which affects display effect, especially in a low grayscale and low frequency display state of the display panel.

SUMMARY

In a first aspect of the present disclosure, a pixel driving circuit is provided. An operating sequence of the pixel driving circuit includes a plurality of operating cycles. Each of the plurality of operating cycles includes a first light-emitting stage and a second light-emitting stage after the first light-emitting stage. The first light-emitting stage includes a data writing stage and a light-emitting stage after the data writing stage, and the second light-emitting stage includes a correcting stage and a light-emitting stage after the correcting stage. The pixel driving circuit includes: a driving module configured to generate a light-emitting driving current during the light-emitting stage; a threshold voltage capturing module electrically connected to the driving module and configured to be turned on and to write a data voltage to a control terminal of the driving module during the data writing stage; and a coupling module electrically connected to the control terminal of the driving module and configured to adjust a coupling voltage of the control terminal of the driving module during the correcting stage and the light-emitting stage.

In a second aspect of the present disclosure, a pixel driving circuit is provided. The pixel driving circuit includes a driving module configured to generate a light-emitting driving current, a threshold voltage capturing module, and a coupling module. The threshold voltage capturing module includes an input terminal electrically connected to an output terminal of the driving module and an output terminal electrically connected to a control terminal of the driving module, and is configured to control an electrical connection state between the control terminal and the output terminal of the driving module. The coupling module includes an input terminal electrically connected to a first signal line and an output terminal electrically connected to the control terminal of the driving module, and is configured to adjust a potential of the control terminal of the driving module based on a signal of the first signal line. The threshold voltage capturing module controls the output terminal of the driving module to be disconnected from the control terminal of the driving module when the coupling module controls the driving module to be turned on by adjusting the potential of the control terminal of the driving module.

In a third aspect of the present disclosure, a method for driving a pixel driving circuit is provided. The pixel driving circuit includes: a driving module configured to generate a light-emitting driving current; a threshold voltage capturing module including an input terminal electrically connected to an output terminal of the driving module, and an output terminal electrically connected to a control terminal of the driving module; and a coupling module including an input terminal electrically connected to a first signal line, and an output terminal electrically connected to a control terminal of the driving module. An operating sequence of the pixel driving circuit includes a plurality of operating cycles, Each of the plurality of operating cycles includes a first light-emitting stage and a second light-emitting stage after the first light-emitting stage. The first light-emitting stage includes a data writing stage and a light-emitting stage after the data writing stage, and the second light-emitting stage includes a correcting stage and a light-emitting stage after the correcting stage. The method includes: during the data writing stage, receiving a data voltage by an input terminal of the driving module, and turning on the threshold voltage capturing module and the driving module to write the data voltage to the control terminal of the driving module; and during the correcting stage, transmitting a first voltage signal by the first signal line, generating a first coupling voltage by the control terminal of the driving module, receiving a data voltage by the input terminal of the driving module, and controlling the driving module to be turned on by the first coupling voltage.

In a third aspect of the present disclosure, a display panel is provided. The display panel includes the pixel driving circuit.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings.

DESCRIPTION OF EMBODIMENTS

In order to better understand the technical solutions of the present disclosure, the embodiments of the present disclosure are described in detail below with reference to the accompanying drawings.

It should be clear that the described embodiments are only a part of the embodiments of the present disclosure, but not all of the embodiments. Based on the embodiments in the present disclosure, all other embodiments obtained by those of ordinary skill in the art fall within the protection scope of the present disclosure.

The terms used in the embodiments of the present disclosure are only for the purpose of describing specific embodiments, and are not intended to limit the present disclosure. As used in the embodiments of this application and the appended claims, the singular forms "a," "the," and "the" are intended to include the plural forms as well, unless the context clearly dictates otherwise.

It should be understood that the term "and/or" used in this document is only an association relationship to describe the associated objects, indicating that there may be three relationships, for example, A and/or B, which may indicate that A alone, A and B, and B alone. The character "/" in this document generally indicates that the related objects are an "or" relationship.

In this specification, it should be understood that words such as "basically", "approximately", "about", "substantially" and "generally" described in the claims and embodiments of the present disclosure refer to a value within a reasonable technological operating ranges or tolerance ranges, which can be generally approved and is not a precise value.

It should be understood that although the terms 'first' and 'second' can be used in the present disclosure to describe transistors and scan lines, these transistors and scan lines should not be limited to these terms. These terms are used only to distinguish the transistors and scan lines from each other. For example, without departing from the scope of the embodiments of the present disclosure, a first transistor can also be referred to as a second transistor. Similarly, the second transistor can also be referred to as the first transistor.

Figure 1:
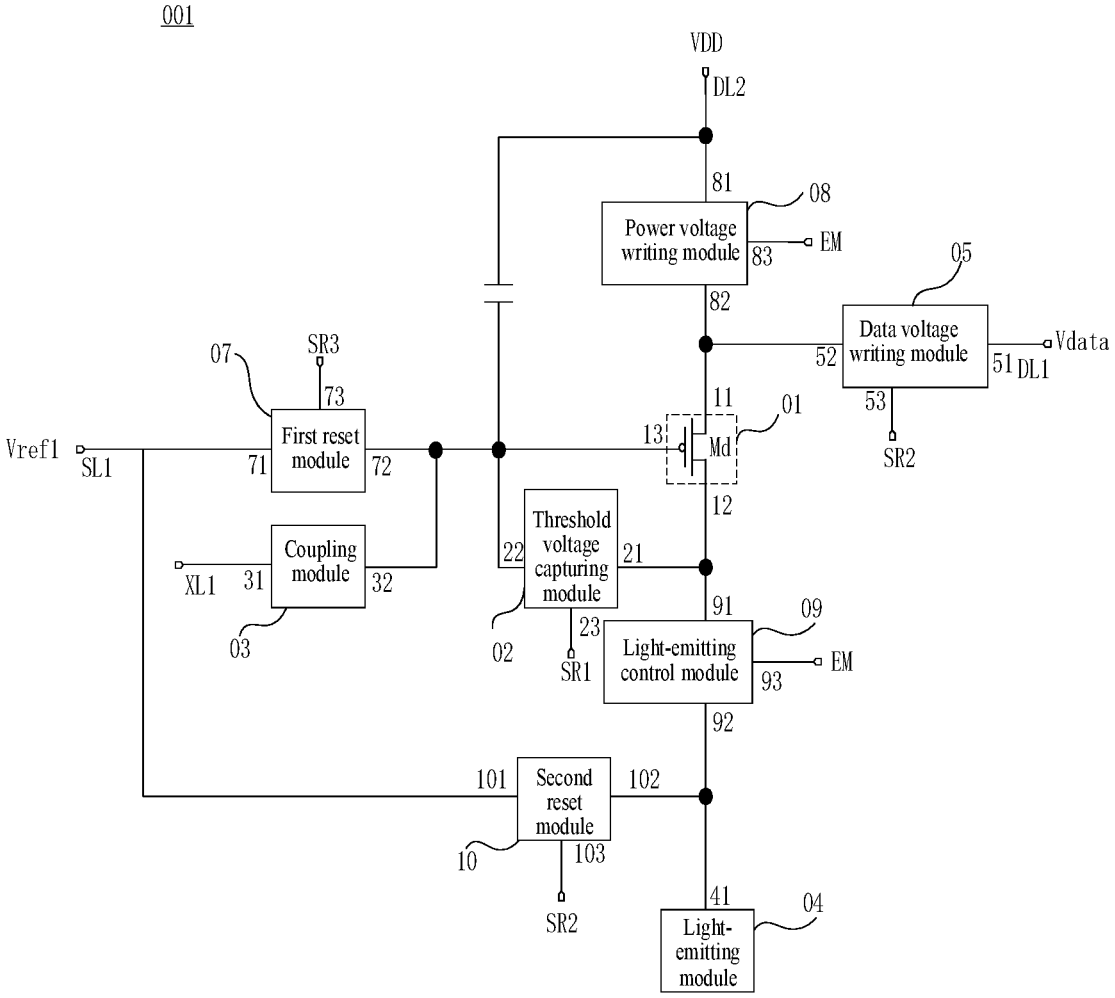
FIG. 1 is a schematic diagram of a pixel driving circuit according to an embodiment of the present disclosure.
Figure 2:
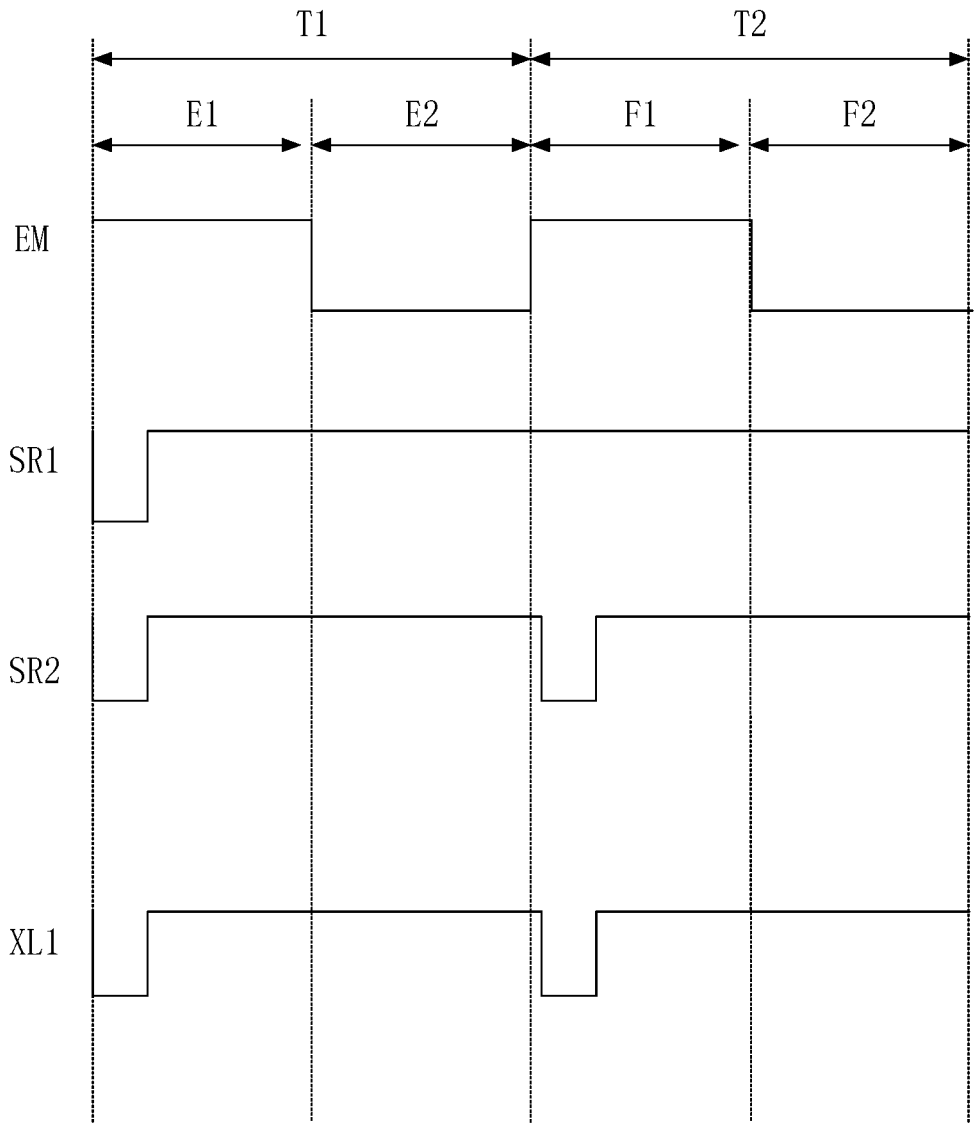
FIG. 2 is an operating timing sequence of a pixel driving circuit according to an embodiment of the present disclosure.

FIG. 1 is a schematic diagram of a pixel driving circuit according to an embodiment of the present disclosure, and FIG. 2 is an operating timing sequence of a pixel driving circuit according to an embodiment of the present disclosure.

As shown in FIG. 1 and FIG. 2, a pixel driving circuit 001 is provided. Referring to FIG. 1 and FIG. 2, an operating sequence of the pixel driving circuit 001 includes multiple operating cycles. The operating cycle includes a first light-emitting stage T1 and a second light-emitting stage T2 after the light-emitting stage T1. The first light-emitting stage T1 includes a data writing stage E1 and a light-emitting stage E2 after the data writing stage E1. The second light-emitting stage T2 includes a correcting stage F1 and a light-emitting stage F2 after the correcting stage F1.

The pixel driving circuit 001 includes a driving module 01, a threshold voltage capturing module 02 and a coupling module 03. The driving module 01 is configured to generate a light-emitting driving current during the light-emitting stage E2 of the first light-emitting stage T1 and the light-emitting stage F2 of the second light-emitting stage T2. The threshold voltage capturing module 02 is electrically connected to the driving module 01, and is configured to be turned on during the data writing stage E1 and write a data voltage Vdata to a control terminal 13 of the driving module 01. The coupling module 03 is electrically connected to the control terminal 13 of the driving module 01, and is configured to adjust a coupling voltage of the control terminal 13 of the driving module 01 during the correcting stage F1 and the light-emitting stage F2 of the second light-emitting stage T2.

In some embodiments, as shown in FIG. 1 and FIG. 2, an input terminal 21 of the threshold voltage capturing module 02 is electrically connected to an output terminal 12 of the driving module 01, an output terminal 22 of the threshold voltage capturing module 02 is electrically connected to a control terminal 13 of the driving module 01, and a control terminal 23 of the threshold voltage capturing module 02 is electrically connected to a first control line SR1. That is to say, the threshold voltage capturing module 02 can transmit a signal output from the driving module 01 to the control terminal 13 of the driving module 01.

During the data writing stage E1 of the first light-emitting stage T1, the first control line SR1 transmits a valid signal to control the threshold voltage capturing module 02 to be turned on. Synchronously, the data voltage Vdata is transmitted to the output terminal 12 of the driving module 01, and is transmitted to the control terminal 13 of the driving module 01 through the turned-on threshold voltage capturing module 02.

An input terminal 31 of the coupling module 03 is electrically connected to a first signal line XL1, and an output terminal 32 of the coupling module 03 is electrically connected to the control terminal 13 of the driving module 01.

During the correcting stage F1 of the second light-emitting stage T2, the first signal line XL1 transmits a first voltage signal. Due to a coupling effect of the coupling module 03, at this time, the control terminal 13 of the driving module 01 generates a first coupling voltage, that is, a potential of the control terminal 13 of the driving module 01 is the first coupling voltage.

During the light-emitting stage F2 of the second light-emitting stage T2, the first signal line XL1 transmits a second voltage signal. Due to a coupling effect of the coupling module 03, the control terminal 13 of the driving module 01 generates a second coupling voltage, that is, a potential of the control terminal 13 of the driving module 01 is the second coupling voltage.

In an initial stage of the light-emitting stage F2 of the second light-emitting stage T2, a potential of the control terminal 13 of the driving module 01 is the second coupling voltage.

The first coupling voltage can control the driving module 01 to be turned on. Synchronously, the data voltage Vdata is transmitted to the input terminal 11 of the driving module 01, and the data voltage Vdata can be transmitted to the output terminal 12 of the driving module 01 through the driving module 01 that is turned on.

The driving module 01 can include a driving transistor Md. Before the light-emitting stage E2 of the first light-emitting stage T1 of the display panel, in order to generate a satisfactory light-emitting driving current by the driving transistor Md, a gate of the driving transistor Md can be reset, and a data voltage Vdata is then written to the gate of the driving transistor Md, so that during the light-emitting stage E2 of the first light-emitting stage T1, the driving transistor Md can generate a satisfactory light-emitting driving current and transmit it to the light-emitting module 04. In an initial light-emitting stage of the light-emitting module 04, there is a current ramping process, and a current ramping speed is related to a bias state of the driving transistor Md.

Figure 3:
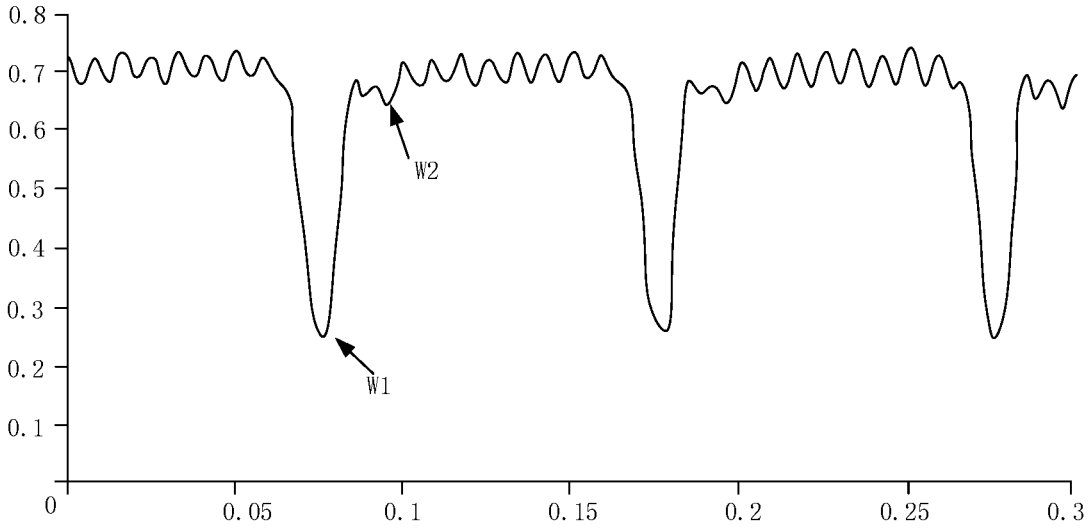
FIG. 3 is a brightness graph when a display panel in the related art operates according to an embodiment of the present disclosure.

FIG. 3 is a brightness graph when a display panel in the related art operates according to an embodiment of the present disclosure.

In the related art, in the second light-emitting stage T2 of the display panel, the gate of the driving transistor Md is no longer reset and the data signal is no longer written thereto, the gate of the driving transistor Md can maintain the potential of the previous light-emitting stage, and a light-emitting driving current is generated under control of the potential of the previous light-emitting stage and transmitted to the light-emitting module 04. In this way, a large bias state difference of the driving transistor Md is formed during an initial stage of the light-emitting stage F2 of the second light-emitting stage T2 and an initial stage of the light-emitting stage E2 of the first light-emitting stage T1, so that there is a large speed difference of the current ramping of the light-emitting module 04 between the first light-emitting stage T1 and the second light-emitting stage T1, and then there is a large brightness difference of the display panel between the first light-emitting stage T1 and the second light-emitting stage T2, thereby affecting normal display of the display panel. As shown in FIG. 3, abscissa (horizontal axis) represents time, ordinate (vertical axis) represents brightness, a position W1 represents brightness of the light-emitting module 04 in the first light-emitting stage T1, and a position W2 represents brightness of the light-emitting module 04 in the second light-emitting stage T2. It can be seen from FIG. 3 that there is a large brightness difference of the light-emitting module 04 between the first light-emitting stage T1 and the second light-emitting stage T2, so that a serious flickering problem occurs in a display image, and it is apparent especially in a low-frequency and low-grayscale display state of the display panel.

In the present disclosure, during the correcting stage F1 of the second light-emitting stage T2, the driving module 01 is turned on through a coupling action of the coupling module 03. Synchronously, the data voltage Vdata is transmitted to the input terminal 11 of the driving module 01, then the data voltage Vdata can be transmitted to the output terminal 12 of the driving module 01 through the driving module 01 turned on, so that the bias state of the driving transistor Md in the driving module 01 is corrected, and a bias state difference of the driving transistor Md between the second light-emitting stage T2 and the first light-emitting stage T1 is reduced. Therefore, a speed difference of the current ramping of the light-emitting module 04 between the first light-emitting stage T1 and the second light-emitting stage T2 is reduced, and then a brightness difference of the display panel between the first light-emitting stage T1 and the second light-emitting stage T2 is reduced, thereby improving the display effect of the display panel.

In an embodiment of the present disclosure, the coupling module 03 is configured to adjust the potential of the control terminal 13 of the driving module 01 to be the first coupling voltage during the correcting stage F1 to control the driving module 01 to be turned on.

In some embodiments, as shown in FIG. 1, the gate of the driving transistor Md is electrically connected to the control terminal 13 of the driving module 01, the source of the driving transistor Md is electrically connected to the input terminal 11 of the driving module 01, and the drain of the driving transistor Md is electrically connected to the output terminal 12 of the driving module 01. The driving transistor Md can be a P-type transistor.

During the correcting stage T1 of the second light-emitting stage T2, the coupling module 03 adjusts the potential of the gate of the driving transistor Md to the first coupling voltage through a coupling action. Synchronously, the data voltage Vdata is transmitted to the source of the driving transistor Md. Since the potential of the data voltage Vdata can be greater than the potential of the first coupling voltage, the driving transistor Md is turned on, that is, the driving module 01 is turned on.

In an embodiment of the present disclosure, referring to FIG. 1 and FIG. 2, the coupling module 03 is further configured to adjust the potential of the control terminal 13 of the driving module 01 to be a second coupling voltage during the light-emitting stage F2 of the second light-emitting stage T2. The second coupling voltage is equal to the data voltage written to the control terminal 13 of the driving module 01.

The data voltage written to the control terminal 13 of the driving module 01 can be (Vdata−|Vth|), where Vth is a threshold voltage of the driving transistor Md.

During the data writing stage E1 of the first light-emitting stage T1, the data voltage Vdata is transmitted to the control terminal 13 of the driving module 01 through the driving module 01 turned-on and the threshold voltage capturing module 02 turned-on. At this time, the potential of the control terminal 13 of the driving module 01 is (Vdata−|Vth|).

In an embodiment of the present disclosure, during the light-emitting stage F2 of the second light-emitting stage T2, the coupling module 03 adjusts the potential of the control terminal 13 of the driving module 01 to be a second coupling voltage that is equal to the data voltage written to the control terminal 13 of the driving module 01, that is, the potential of the control terminal 13 of the driving module 01 is (Vdata−|Vth|). It is ensured that during the light-emitting stage E2 of the first light-emitting stage T1 and the light-emitting stage F2 of the second light-emitting stage T2, the driving transistor Md generates the light-emitting driving current with the same data voltage Vdata, so that a difference of current received by the light-emitting module 04 between the first light-emitting stage T1 and the second light-emitting stage T2 is reduced, and then a brightness difference of the display panel between the first light-emitting stage T1 and the second light-emitting stage T2 is reduced, thereby improving the display effect of the display panel.

Referring to FIG. 1 and FIG. 2, in an embodiment of the present disclosure, the pixel driving circuit 001 further includes a data voltage writing module 05. The data voltage writing module 05 is electrically connected to the driving module 01. The data voltage writing module 05 is configured to write the data voltage Vdata to the input terminal 11 of the driving module 01 during the data writing stage E1 and the correcting stage F1.

In some embodiments, the input terminal 51 of the data voltage writing module 05 is electrically connected to the data voltage signal line DL1, the output terminal 52 of the data voltage writing module 05 is electrically connected to the input terminal 11 of the driving module 01, and the control terminal 53 of the data voltage writing module 05 is electrically connected to a second control line SR2.

During the data writing stage E1 and the correcting stage F1, the second control line SR2 transmits a valid signal to control the data voltage writing module 05 to be turned on. Synchronously, the data voltage Vdata is transmitted by the data voltage signal line DL1 to the input terminal 11 of the driving module 01 through the data voltage writing module 05 turned on.

Figure 4:
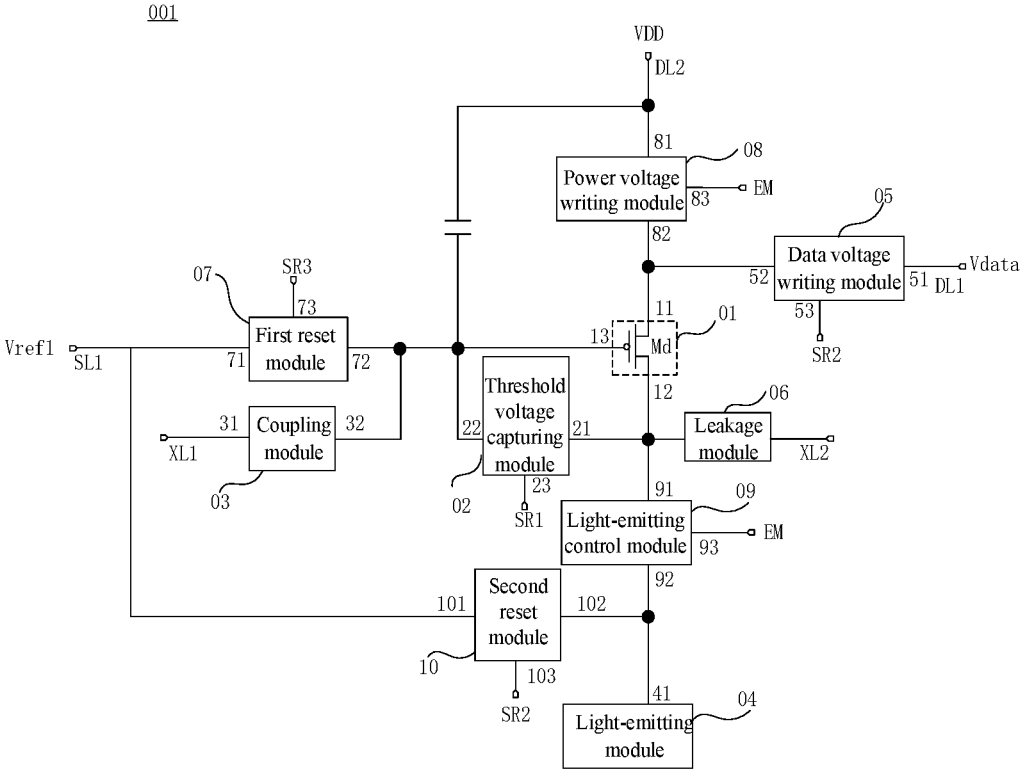
FIG. 4 is a schematic diagram of a pixel driving circuit according to another embodiment of the present disclosure.

FIG. 4 is a schematic diagram of a pixel driving circuit according to another embodiment of the present disclosure.

In an embodiment of the present disclosure, as shown in FIG. 2 and FIG. 4, the pixel driving circuit 001 further includes a current-leakage module 06. One terminal of the current-leakage module 06 is electrically connected to the output terminal 12 of the driving module 01. The current-leakage module 06 is configured to generate a current flowing through the driving module 01 during the correcting stage F1 by the data voltage Vdata.

Another terminal of the current-leakage module 06 can be electrically connected to a fixed-potential signal line XL2. During the correcting stage F1 of the second light-emitting stage T2, the driving module 01 and the current-leakage module 06 that are turned on generates a current flowing through the driving module 01 by the data voltage Vdata, which corrects the bias state of the driving transistor Md of the driving module 01. Thus, a bias state difference of the driving transistor Md between the second light-emitting stage T2 and the first light-emitting stage T1 decreases, and a speed difference of the ramping current of the light-emitting module 04 between the first light-emitting stage T1 and the second light-emitting stage T2 decreases, so that the brightness difference of the display panel between the first light-emitting stage T1 and the second light-emitting stage T2 further decreases, thereby improving the display effect of the display panel.

Figure 5:
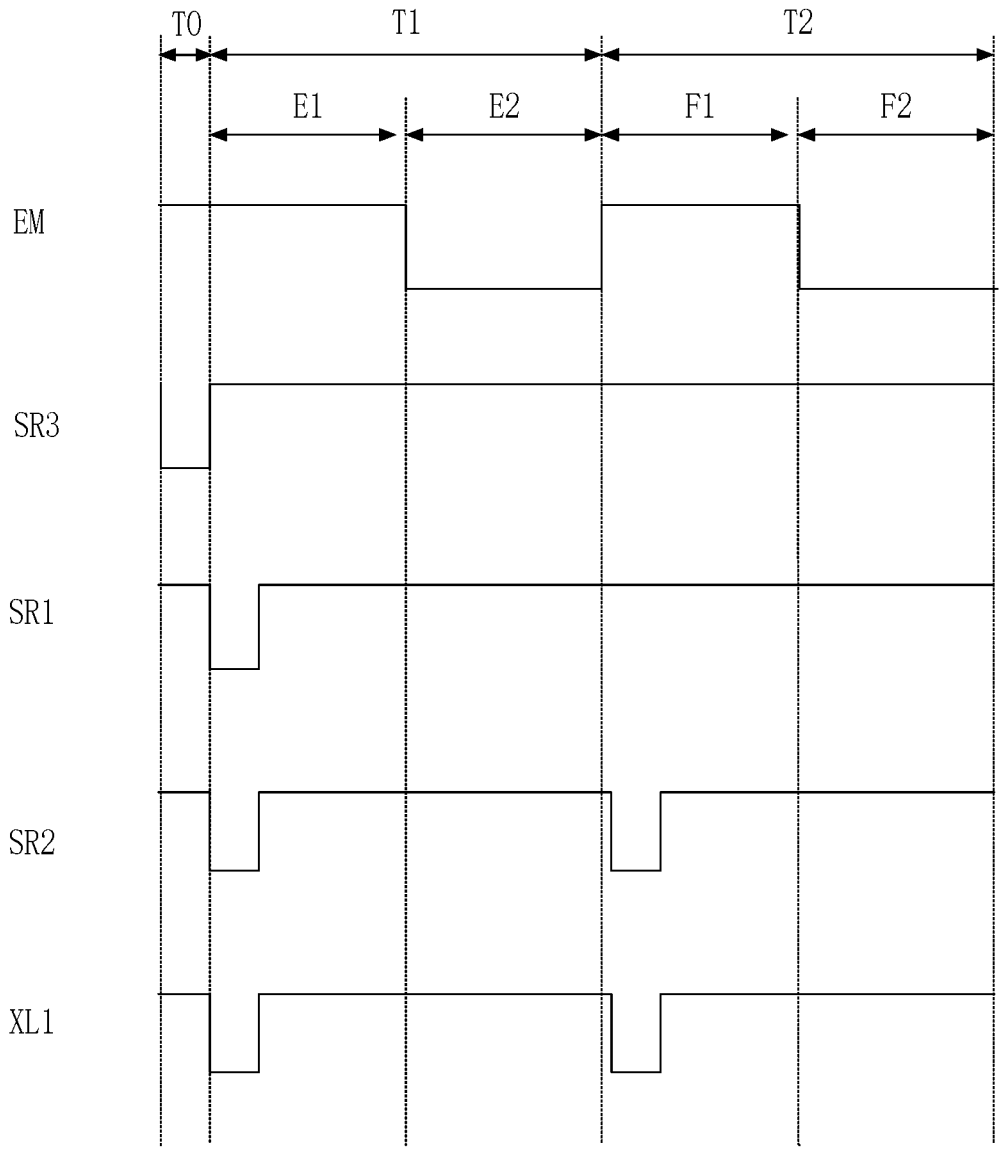
FIG. 5 is an operating timing sequence of a pixel driving circuit according to another embodiment of the present disclosure.

FIG. 5 is an operating timing sequence of a pixel driving circuit according to another embodiment of the present disclosure.

As shown in FIG. 5, in an embodiment of the present disclosure, an operating cycle of the pixel driving circuit 001 further includes a first reset stage T0 performed before the first light-emitting stage T1.

Referring to FIG. 1, FIG. 4, or FIG. 5, the pixel driving circuit 001 further includes a first reset module 07. The first reset module 07 is electrically connected to the control terminal 13 of the driving module 01, and is configured to reset the control terminal 13 of the driving module 01 in the first reset stage T0.

In some embodiments, as shown in FIG. 1 and FIG. 4, an input terminal 71 of the first reset module 07 is electrically connected to a first resetting line SL1, an output terminal 72 of the first reset module 07 is electrically connected to the control terminal 13 of the driving module 01, and a control terminal 73 of the first reset module 07 is electrically connected to a third control line SR3.

In the first reset stage T0, the third control line SR3 transmits a valid signal to control the first reset module 07 to be turned on; synchronously, the first resetting line SL1 transmits a first resetting voltage Vref1 which is transmitted to the control terminal 13 of the driving module 01 through the first reset module 07 to reset the control terminal 13 of the driving module 01.

In an embodiment of the present disclosure, as shown in FIG. 1 and FIG. 4, the pixel driving circuit 001 includes a power voltage writing module 08 and a light-emitting control module 09. An input terminal 81 of the power voltage writing module 08 is electrically connected to a power voltage signal line DX2, an output terminal 82 of the power voltage writing module 08 is electrically connected to the input terminal 11 of the driving module 01, and a control terminal 83 of the power voltage writing module 08 is electrically connected to a light-emitting control signal line EM. An input terminal 91 of the light-emitting control module 09 is electrically connected to the output terminal 12 of the driving module 01, an output terminal 92 of the light-emitting control module 09 is electrically connected to an input terminal 41 of the light-emitting module 04, and a control terminal 93 of the light-emitting control module 09 is electrically connected to the light-emitting control signal line EM. The signal of the light-emitting control signal line EM controls the power voltage writing module 08 and the light-emitting control module 09 to have the same on-off state.

Referring to FIG. 1 and FIG. 4, the pixel driving circuit 001 can include a second reset module 10. An input terminal 101 of the second reset module 10 can be electrically connected to the first resetting line SL1, an output terminal 102 of the second reset module 10 is electrically connected to the input terminal of the light-emitting module 04, and a control terminal 103 can be electrically connected to the second control line SR2. During the data writing stage E1 of the first light-emitting stage T1, the second reset module 10 is configured to reset the input terminal 41 of the light-emitting module 04.

The second reset module 10 can also reset the input terminal 41 of the light-emitting module 04 in the first reset stage T0.

In an embodiment of the present disclosure, the operating cycle of the pixel driving circuit 001 includes the first reset stage T0, the first light-emitting stage T1, and the second light-emitting stage T2 that are sequentially performed. The first light-emitting stage T1 includes the data writing stage E1 and the light-emitting stage E2 that are sequentially performed. The second light-emitting stage T2 includes the correcting stage F1 and the light-emitting stage F2 that are sequentially performed.

During the first reset stage T0, the first reset module 07 is turned on, and the first resetting voltage Vref1 resets the control terminal 13 of the driving module 01 through the first reset module 07 that is turned on.

During the data writing stage E1 of the first light-emitting stage T1, the data voltage Vdata is written to the control terminal 13 of the driving module 01 through the data voltage writing module 05, the driving module 01 and the threshold voltage capturing module 02 that are turned-on. Synchronously, the first resetting voltage Vref1 resets the input terminal 41 of the light-emitting module 04 through the second reset module 10 turned on. During the light-emitting stage E2 of the first light-emitting stage T1, the power voltage writing module 08 and the light-emitting control module 09 are turned on, and the power voltage writing module 08 transmits the power voltage VDD of the power voltage signal line DX2 to the input terminal 11 of the driving module 01, so that the driving module 01 generates a light-emitting driving current. The light-emitting control module 09 transmits the light-emitting driving current generated by the driving module 01 to the light-emitting module 04.

During the correcting stage F1 of the second light-emitting stage T2, the coupling module 03 adjusts the potential of the control terminal 13 of the driving module 01 to be the first coupling voltage. The first coupling voltage controls the driving module 01 to be turned on. The data voltage Vdata is transmitted to the output terminal 12 of the driving module 01 through the data voltage writing module 05 and the driving module 01 that are turned on. Synchronously, since the current-leakage module 06 is provided, the data voltage Vdata generates a current flowing through the driving module 01, so that the bias state of the driving transistor Md in the driving module 01 is corrected. During the light-emitting stage F2 of the second light-emitting stage T2, the coupling module 03 adjusts the potential of the control terminal 13 of the driving module 01 to be the second coupling voltage. The second coupling voltage is the same as the potential of the control terminal 13 of the driving module 01 when the data writing stage E1 is completed. Synchronously, the power voltage writing module 08 and the light-emitting control module 09 are turned on. The power voltage writing module 08 transmits the power voltage VDD of the power voltage signal line DX2 to the input terminal 11 of the driving module 01, so that the driving module 01 generates a light-emitting driving current. The light-emitting control module 09 transmits the light-emitting driving current generated by the driving module 01 to the light-emitting module 04.

In an embodiment of the present disclosure, by correcting the bias state of the driving transistor Md in the driving module 01 during the correcting stage F1 of the second light-emitting stage T2, the bias state difference of the driving transistor Md between the second light-emitting stage T2 and the first light-emitting stage T1 decreases, so that the speed difference of the ramping current of the light-emitting module 04 between the first light-emitting stage T1 and the second light-emitting stage T2 decreases, and the brightness difference of the display panel between the first light-emitting stage T1 and the second light-emitting stage T2 decreases, thereby improving the display effect of the display panel.

In an embodiment of the present disclosure, a pixel driving circuit 001 is provided. Referring to FIG. 1 and FIG. 2, the pixel driving circuit 001 includes a driving module 01, a threshold voltage capturing module 02 and a coupling module 03. The driving module 01 is configured to generate a light-emitting driving current. An input terminal 21 of the threshold voltage capturing module 02 is electrically connected to an output terminal 12 of the driving module 01, and an output terminal 22 of the threshold voltage capturing module 02 is electrically connected to a control terminal 13 of the driving module 01. The threshold voltage capturing module 02 is configured to control an electrical connection state between the control terminal 13 and the output terminal 12 of the driving module 01. An input terminal 31 of the coupling module 03 is electrically connected to a first signal line XL1, and an output terminal 32 of the coupling module 03 is electrically connected to the control terminal 13 of the driving module 01. The coupling module 03 is configured to adjust the potential of control terminal 13 of the driving module 01 according to a signal of the first signal line XL1.

When the coupling module 03 adjusts the potential of the control terminal 13 of the driving module 01 to turn on the driving module 01, the threshold voltage capturing module 02 controls the output terminal 12 of the driving module 01 to disconnect the control terminal 13 of the driving module 01, that is, there is a disconnected state between the output terminal 12 of the driving module 01 and the control terminal 13 of the driving module 01. That is to say, when the coupling module 03 adjusts the potential of the control terminal 13 of the driving module 01 to turn on the driving module 01, the threshold voltage capturing module 02 is turned off.

An operating sequence of the pixel driving circuit 001 includes multiple operating cycles. One operating cycle includes a first light-emitting stage T1 and a second light-emitting stage T2 after the first light-emitting stage T1. The first light-emitting stage T1 includes a data writing stage E1 and a light-emitting stage E2 after the data writing stage E1. The second light-emitting stage T2 includes a correcting stage F1 and a light-emitting stage F2 after the correcting stage F1.

During the data writing stage E1, the input terminal 11 of the driving module 01 receives a data voltage Vdata, and the threshold voltage capturing module 02 is turned on. The data voltage Vdata is written to the control terminal 13 of the driving module 01 through the driving module 01 and the threshold voltage capturing module 02 that are turned on.

During the correcting stage F1, the first signal line XL1 transmits a first voltage signal, the coupling module 03 adjusts a potential of the control terminal 13 of the driving module 01 to be the first coupling voltage according to the first voltage signal, and the first coupling voltage controls the driving module 01 to be turned on. At this time, the input terminal 11 of the driving module 01 receives the data voltage Vdata. That is to say, during the correcting stage F1, the data voltage Vdata can be transmitted to the output terminal 12 of the driving module 01 through the driving module 01 turned on, so as to correct the bias state of the driving transistor Md in the driving module 01. Synchronously, the threshold voltage capturing module 02 is turned off to prevent the data voltage Vdata from being transmitted to the control terminal 13 of the driving module 01, thereby avoiding affecting the accuracy of the light-emitting driving current.

During an initial light-emitting stage of the light-emitting module 04, there is a current ramping process, and the current ramping speed is related to the bias state of the driving transistor Md.

In the related art, three is a large bias state difference of the driving transistor Md between an initial stage of the light-emitting stage F2 of the second light-emitting stage T2 and an initial stage of the light-emitting stage E2 of the first light-emitting stage T1, so that there is a large speed difference of the current ramping of the light-emitting module 04 between the first light-emitting stage T1 and the second light-emitting stage T2, thereby resulting in a large brightness difference of the display panel between the first light-emitting stage T1 and the second light-emitting stage T2, and affecting normal display of the display panel. For example, in the low-frequency and low-gray-scale display state of the display panel, it is liable to have serious flickering on the display screen.

In the present disclosure, by correcting the bias state of the driving transistor Md in the driving module 01 during the correcting stage F1 of the second light-emitting stage T2, it is beneficial to reduce the bias state difference of the transistor Md between the second light-emitting stage T2 and the first light-emitting stage T1, so that the speed difference of the ramping speed received by the light-emitting module 04 between the first light-emitting stage T1 and the second light-emitting stage T2 is reduced, and the brightness difference of the display panel between the first light-emitting stage T1 and the second light-emitting stage T2 is reduced, thereby improving the display effect of the display panel.

During the light-emitting stage F2 of the second light-emitting stage T2, the first signal line XL1 transmits a second voltage signal, and the coupling module 03 adjusts a potential of the control terminal 13 of the driving module 01 to be a second coupling voltage according to the second voltage signal. The second coupling voltage is equal to the data voltage written to the control terminal 13 of the driving module 01.

The data voltage written to the control terminal 13 of the driving module 01 can be (Vdata−|Vth|), where Vth is a threshold voltage of the driving transistor Md.

In view of the above analysis, during the data writing stage E1 of the first light-emitting stage T1, the data voltage Vdata is transmitted to the control terminal 13 of the driving module 01 through the driving module 01 and the threshold voltage capturing module 02 that are turned-on. At this time, a potential of the control terminal 13 of the driving module 01 is (Vdata−|Vth|).

In an embodiment of the present disclosure, during the light-emitting stage F2 of the second light-emitting stage T2, the coupling module 03 adjusts a potential of the control terminal 13 of the driving module 01 to be a second coupling voltage equal to the data voltage written to the control terminal 13 of the driving module 01. That is, the potential of the control terminal 13 of the driving module 01 is (Vdata−|Vth|). It is ensured that during the light-emitting stage E2 of the first light-emitting stage T1 and the light-emitting stage F2 of the second light-emitting stage T2, the driving transistor Md generates a light-emitting driving current with the same data voltage Vdata, so that a difference of current received by the light-emitting module 04 between the first light-emitting stage T1 and the second light-emitting stage T2 is reduced, and then a brightness difference of the display panel between the first light-emitting stage T1 and the second light-emitting stage T2 is reduced, thereby improving the display effect of the display panel.

Figure 6:
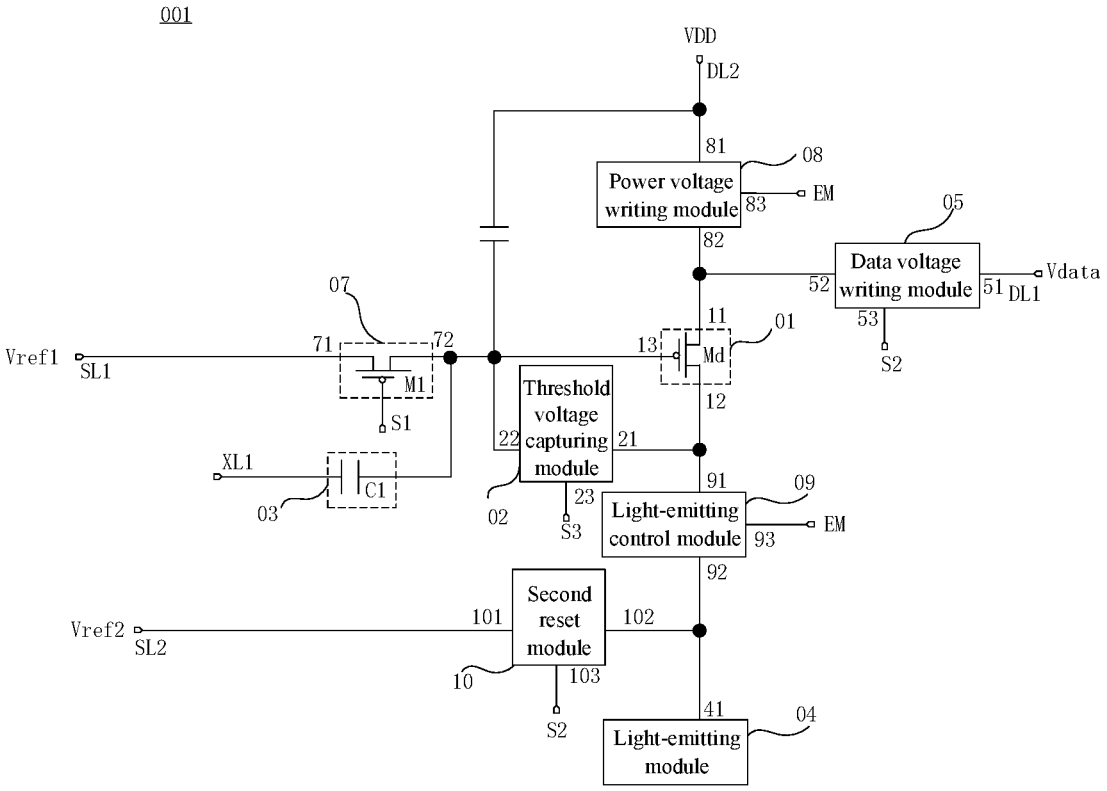
FIG. 6 is a schematic diagram of a pixel driving circuit according to another embodiment of the present disclosure.

FIG. 6 is a schematic diagram of a pixel driving circuit according to another embodiment of the present disclosure.

In an embodiment of the present disclosure, as shown in FIG. 6, the coupling module 03 includes a first capacitor C1. The first capacitor C1 includes a first electrode plate electrically connected to the first signal line XL1, and a second electrode plate electrically connected to the control terminal 13 of the driving module 01.

Since a coupling signal can be generated between the two electrode plates of the first capacitor C1, when the first signal line XL1 transmits a first voltage signal, the control terminal 13 of the driving module 01 generates a first coupling voltage, and the first coupling voltage controls the driving module 01 to be turned on. When the first signal line XL1 transmits a second voltage signal, the control terminal 13 of the driving module 01 generates a second coupling voltage, and the second coupling voltage is the same as the data voltage written to the control terminal 13 of the driving module 01.

Referring to FIG. 1, FIG. 4 and FIG. 6, in an embodiment of the present disclosure, the pixel driving circuit 001 further includes a first reset module 07. The first reset module 07 includes an input terminal 71 electrically connected to the first resetting line SL1, an output terminal 72 electrically connected to the control terminal 13 of the driving module 01. The first reset module 07 is configured to reset the control terminal 13 of the driving module 01.

In some embodiments, referring to FIG. 5, an operating cycle of the pixel driving circuit 001 includes a first reset stage T0 prior to the first light-emitting stage T1.

During the first reset stage T0, the first resetting line SL1 transmits a first resetting voltage Vref1, and the first reset module 07 is turned on to transmit the first resetting voltage Vref1 to the control terminal 13 of the driving module 01, so as to reset the control terminal 13 of the driving module 01.

During the second light-emitting stage T2, the first reset module 07 is turned off. That is to say, when the coupling module 03 adjusts a potential of the control terminal 13 of the driving module 01, the first reset module 07 is turned off to prevent the first resetting voltage Vref1 from affecting the potential of the control terminal 13 of the driving module 01.

Referring to FIG. 6, in an embodiment of the present disclosure, the first reset module 07 includes a first transistor M1. The first transistor M1 includes a first electrode electrically connected to the first resetting line SL1, a second electrode electrically connected to the control terminal 13 of the driving module 01, and a gate electrically connected to the first scan line S1.

During the first reset stage T0, a signal of the first scan line S1 controls the first transistor M1 to be turned on; synchronously, a first resetting voltage Vref1 is transmitted by the first resetting line SL1 to the control terminal 13 of the driving module 01 through the first transistor M1 turned on so as to reset the control terminal 13 of the driving module 01.

During the second light-emitting stage T2, the signal of the first scan line S1 controls the first transistor M1 to be turned off. When the coupling module 03 adjusts a potential of the control terminal 13 of the driving module 01, the first resetting voltage Vref1 is prevented from affecting the potential of the control terminal 13 of the driving module 01.

In an embodiment, the first transistor M1 can include a metal oxide active layer.

Figure 7:
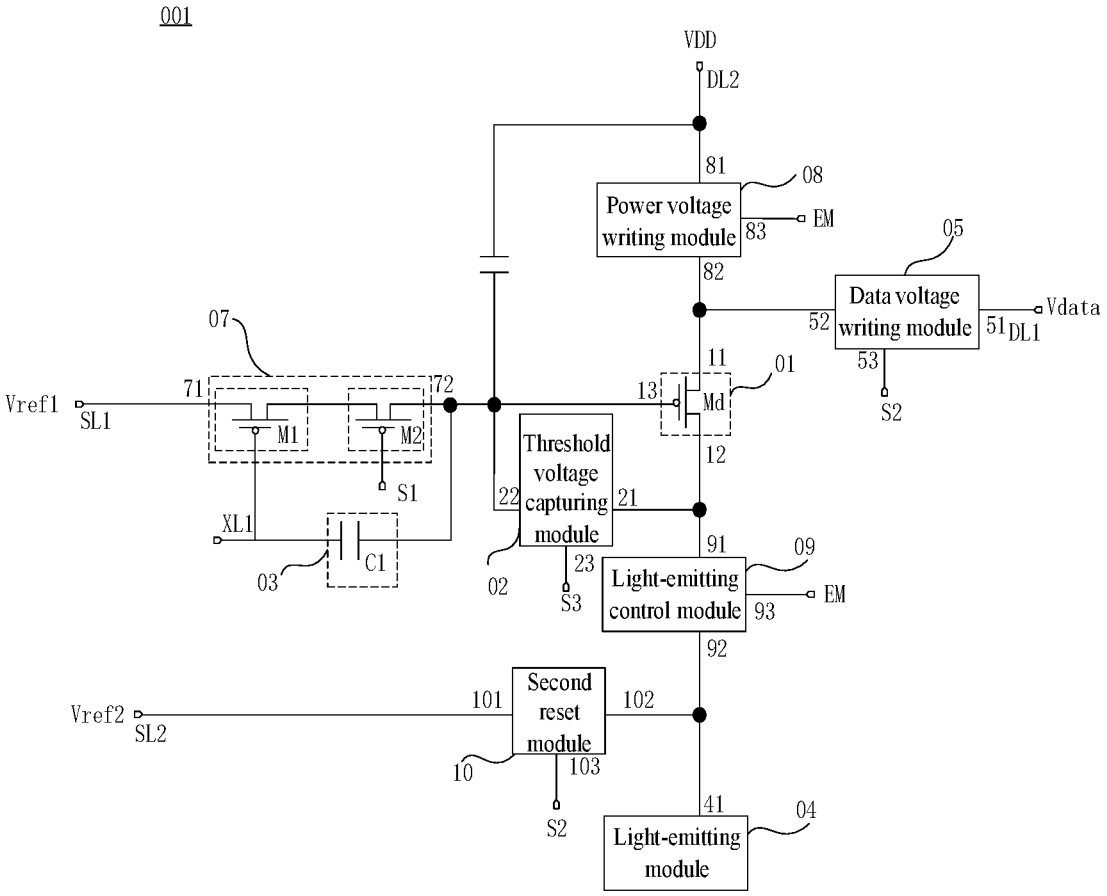
FIG. 7 is a schematic diagram of a pixel driving circuit according to another embodiment of the present disclosure.

FIG. 7 is a schematic diagram of a pixel driving circuit according to another embodiment of the present disclosure.

In an embodiment of the present disclosure, as shown in FIG. 7, the first reset module 07 includes a first transistor M1 and a second transistor M2. The first transistor M1 includes a first electrode electrically connected to the first resetting line SL1, a second electrode electrically connected to a first electrode of the second transistor M2. The second transistor M2 includes a second electrode electrically connected to a control terminal 13 of the driving module 01.

A gate of one of the first transistor M1 and the second transistor M2 is electrically connected to the first signal line XL1, and a gate of the other of the first transistor M1 and the second transistor M2 is electrically connected to the first scan line S1. That is, the first signal line XL1 can be reused a control gate line of the first transistor M1 or the second transistor M2.

For example, as shown in FIG. 7, the gate of the first transistor M1 is electrically connected to the first signal line XL1, and the gate of the second transistor M2 is electrically connected to the first scan line S1. In an embodiment, the gate of the first transistor M1 is electrically connected to the first scan line S1, and the gate of the second transistor M2 is electrically connected to the first signal line XL1.

In an embodiment, in the first transistor M1 and the second transistor M2, a signal received by one gate electrically connected to the first signal line XL1 is the same as the signal received by the first electrode plate of the first capacitor C1.

The first voltage signal of the first signal line XL1 controls the first transistor M1 or the second transistor M2 electrically connected thereto to be turned on.

At least one of the first transistor M1 or the second transistor M2 (that is, the first transistor M1 alone, the second transistor M2 alone, or the first transistor M1 and the second transistor M2) includes a metal oxide active layer.

The metal oxide active layer can be an indium gallium zinc oxide (IGZO) active layer. Since an off-state leakage current of the oxide semiconductor transistor is low, at least one of the first transistor M1 and the second transistor M2 can effectively reduce the influence of the leakage current on the potential stability of the control terminal 13 of the driving module 01, which is beneficial to the low-frequency driving stability of pixel driving circuit 001.

Figure 8:
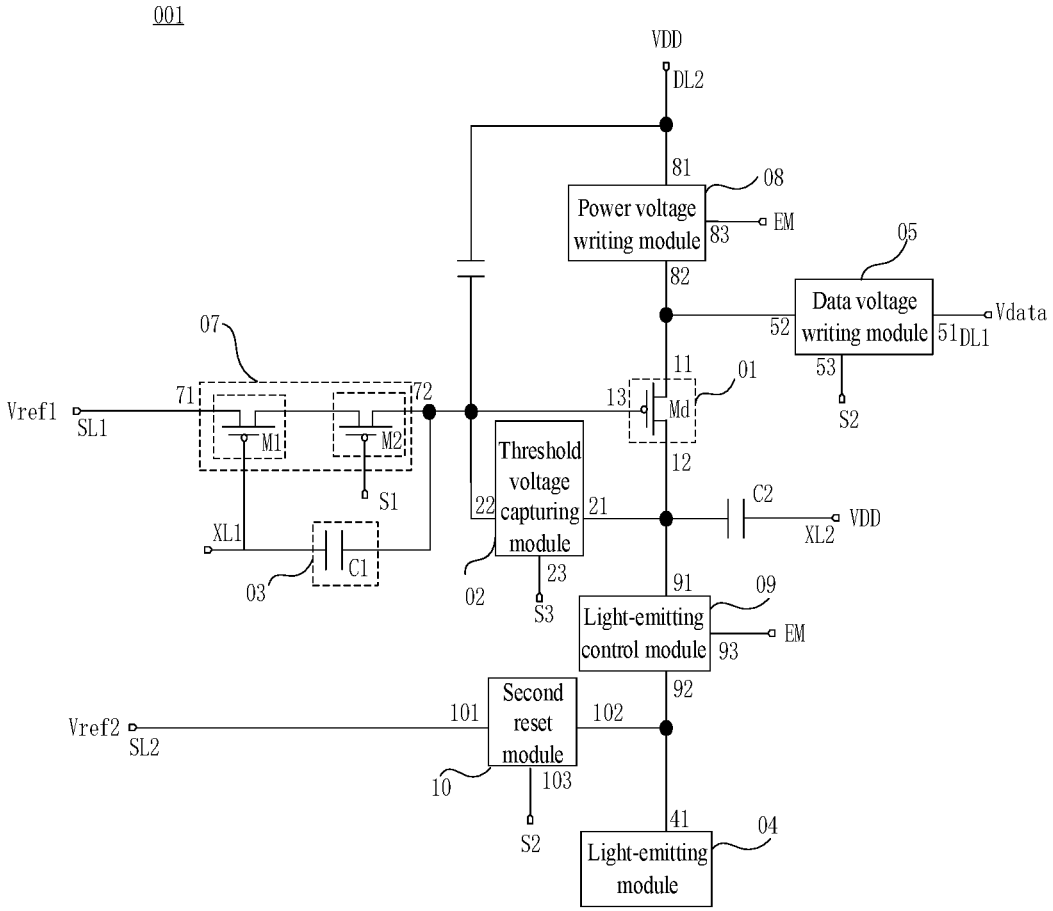
FIG. 8 is a schematic diagram of a pixel driving circuit according to another embodiment of the present disclosure.

FIG. 8 is a schematic diagram of a pixel driving circuit according to another embodiment of the present disclosure.

In an embodiment of the present disclosure, as shown in FIG. 8, the pixel driving circuit 001 includes a second capacitor C2. The second capacitor C2 includes a first electrode plate electrically connected to the output terminal 12 of the driving module 01, and a second electrode plate electrically connected to a fixed-potential signal line XL2.

In an embodiment, the fixed-potential signal line XL2 is electrically connected to a power voltage signal line DL2. That is, the second electrode plate of the second capacitor C2 can receive a power voltage VDD of the power voltage signal line DL2.

Since the second electrode plate of the second capacitor C2 receives a fixing voltage, during the correcting stage F1 of the second light-emitting stage T2, the data voltage Vdata can be charged to the first electrode plate of the second capacitor C2 through the driving module 01 turned on, so that a current flowing through the driving module 01 is generated, thereby correcting the bias state of the driving transistor Md in the driving module 01. Therefore, a bias state difference of the driving transistor Md between the second light-emitting stage T2 and the first light-emitting stage T1 is reduced, and a speed difference of the current ramping of the light-emitting module 04 between the first light-emitting stage T1 and the second light-emitting stage T2 is reduced, and then a brightness difference of the display panel between the first light-emitting stage T1 and the second light-emitting stage T2 is reduced, thereby improving the display effect of the display panel.

Referring to FIG. 6 to FIG. 8, in an embodiment of the present disclosure, the pixel driving circuit 001 includes a data voltage writing module 05. The data voltage writing module 05 includes an input terminal 51 electrically connected to the data voltage signal line DL1, an output terminal 52 electrically connected to the input terminal 11 of the driving module 01, and a control terminal 53 electrically connected to the second scan line S2. The data voltage writing module 05 is configured to write the data voltage Vdata to the input terminal 11 of the driving module 01.

In an embodiment, during the data writing stage E1 and the correcting stage F1, the second scan line S2 transmits a signal to control the data voltage writing module 05 to be turned on, and the data voltage Vdata transmitted on the data voltage signal line DL1 is written into the input terminal 11 of the driving module 01. Therefore, it is ensured that during the data writing stage E1, the data voltage Vdata can be transmitted to the control terminal 13 of the driving module 01 through the driving module 01 and the threshold voltage capturing module 02 that are turned on. During the correcting stage F1, the data voltage Vdata can be transmitted to the output terminal 12 of the driving module 01 through the driving module 01 turned on, thereby correcting the bias state of the driving transistor Md in the driving module 01.

Figure 9:
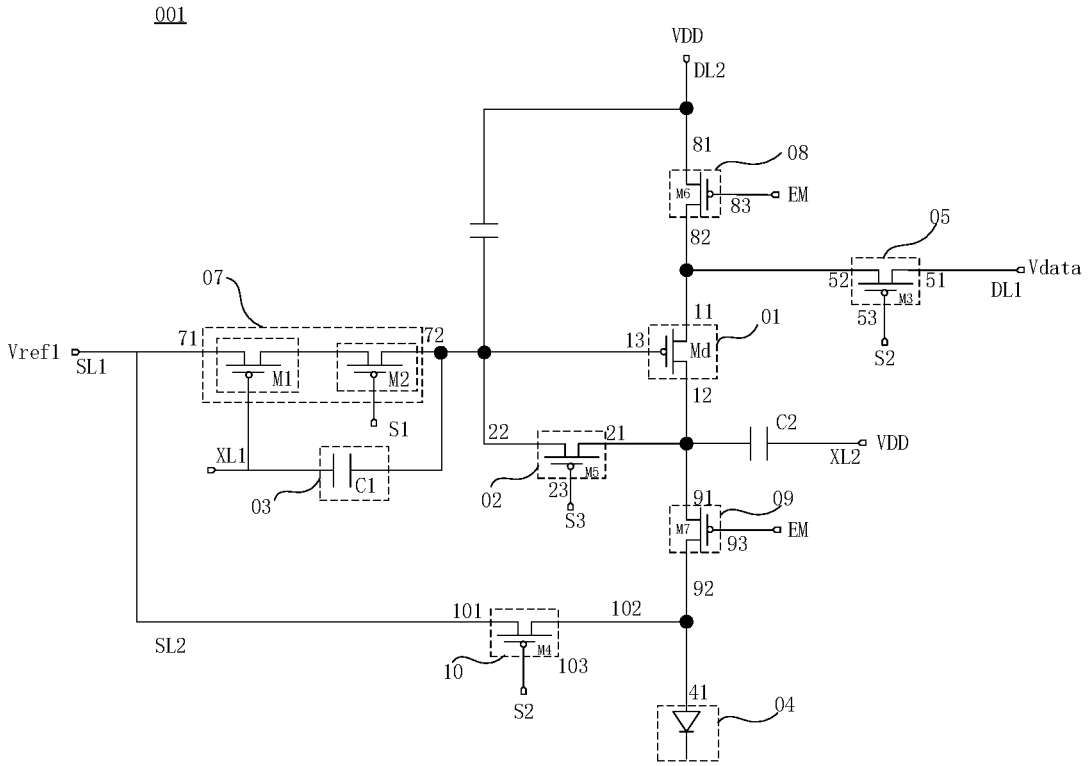
FIG. 9 is a schematic diagram of a pixel driving circuit according to another embodiment of the present disclosure.

FIG. 9 is a schematic diagram of a pixel driving circuit according to another embodiment of the present disclosure.

Referring to FIG. 6 to FIG. 8, the pixel driving circuit 001 includes a light-emitting module 04 and a second reset module 10. The second reset module 10 includes an input terminal 101 electrically connected to the second resetting line SL2, an output terminal 102 electrically connected to the light-emitting module 04, and a control terminal 103 electrically connected to the second scan line S2.

The second reset module 10 and the data voltage writing module 05 that are controlled by a signal of the second scan line S2 have a same on-off state.

The second reset module 10 is configured to reset the light-emitting module 04. When the data voltage writing module 05 is turned on, the second reset module 10 is turned on; synchronously, the second resetting line SL2 transmits a second resetting voltage Vref2 which is transmitted to the light-emitting module 04 through the second reset module 10 turned on to reset the light module 04. In an embodiment, the light-emitting module 04 is an organic light-emitting diode, and the second resetting voltage Vref2 resets the anode of the organic light-emitting diode.

In an embodiment, as shown in FIG. 9, the first resetting line SL1 is electrically connected to the second resetting line SL2. That is, the first resetting voltage Vref1 is reused the second resetting voltage Vref2.

In an embodiment of the present disclosure, the second reset module 10 and the data voltage writing module 05 share a same second scan line S2 reset module, it is beneficial to reduce the number of control lines in the pixel driving circuit 001, thereby facilitating the design and preparation process of the peripheral driving circuit, and reducing production cost.

Referring to FIG. 9, in an embodiment of the present disclosure, the data voltage writing module 05 includes a third transistor M3. The third transistor M3 includes a first electrode electrically connected to the data voltage signal line DL1, a second electrode electrically connected to the input terminal 11 of the driving module 01, and a gate electrically connected to the second scan line S2.

The second reset module 10 includes a fourth transistor M4. The fourth transistor M4 includes a first electrode electrically connected to the second resetting line SL2, a second electrode electrically connected to the input terminal 41 of the light-emitting module 04, and a gate electrically connected to the second scan line S2.

The third transistor M3 and the fourth transistor M4 have a same channel type. The third transistor M3 and the fourth transistor M4 that are controlled by the signal of the second scan line S2 have a same on-off state.

In an embodiment of the present disclosure, as shown in FIG. 9, the control terminal 23 of the threshold voltage capturing module 02 is electrically connected to the third scan line S3. A signal of the third scan line S3 controls the on-off state of the threshold voltage capturing module 02.

In some embodiments, during the data writing stage E1, a signal of the third scan line S3 controls the threshold voltage capturing module 02 to be turned on, ensuring that the data voltage Vdata can be written into the control terminal 13 of the driving module 01 during the data writing stage E1. During the correcting stage F1, the signal of the third scan line S3 controls the threshold voltage capturing module 02 to be turned off. Therefore, during the correcting stage F1, it is prevented to write the data voltage Vdata to the control terminal 13 of the driving module 01, which does not affect the accuracy of the light-emitting driving current.

The threshold voltage capturing module 02 includes a fifth transistor M5. The fifth transistor M5 includes a first electrode electrically connected to the output terminal 12 of the driving module 01, a second electrode electrically connected to the control terminal 13 of the driving module 01, and a gate electrically connected to the third scan line S3.

In an embodiment, the fifth transistor M5 includes a metal oxide active layer.

The metal oxide active layer can be an indium gallium zinc oxide (IGZO) active layer. Since an off-state leakage current of the oxide semiconductor transistor is low, the fifth transistor M5 can reduce the effect of the leakage current on the potential stability of the control terminal 13 of the driving module 01, which is beneficial to the low-frequency driving stability of pixel driving circuit 001.

Referring to FIG. 9, the pixel driving circuit 001 further includes a sixth transistor M6 and a seventh transistor M7. The sixth transistor M6 includes a first electrode electrically connected to the power voltage signal line DL2, a second electrode electrically connected to the input terminal 11 of the driving module 01, and a gate electrically connected to the light-emitting control signal line EM.

The seventh transistor M7 includes a first electrode electrically connected to the output terminal 12 of the driving module 01, a second electrode electrically connected to the light-emitting module 04, and a gate electrically connected to the light-emitting control signal line EM.

The sixth transistor M6 and the seventh transistor M7 have a same channel type.

That is, the signal of the light-emitting control signal line EM controls the on-off state of the sixth transistor M6 and the on-off state of the seventh transistor M7 to be the same.

Figure 10:
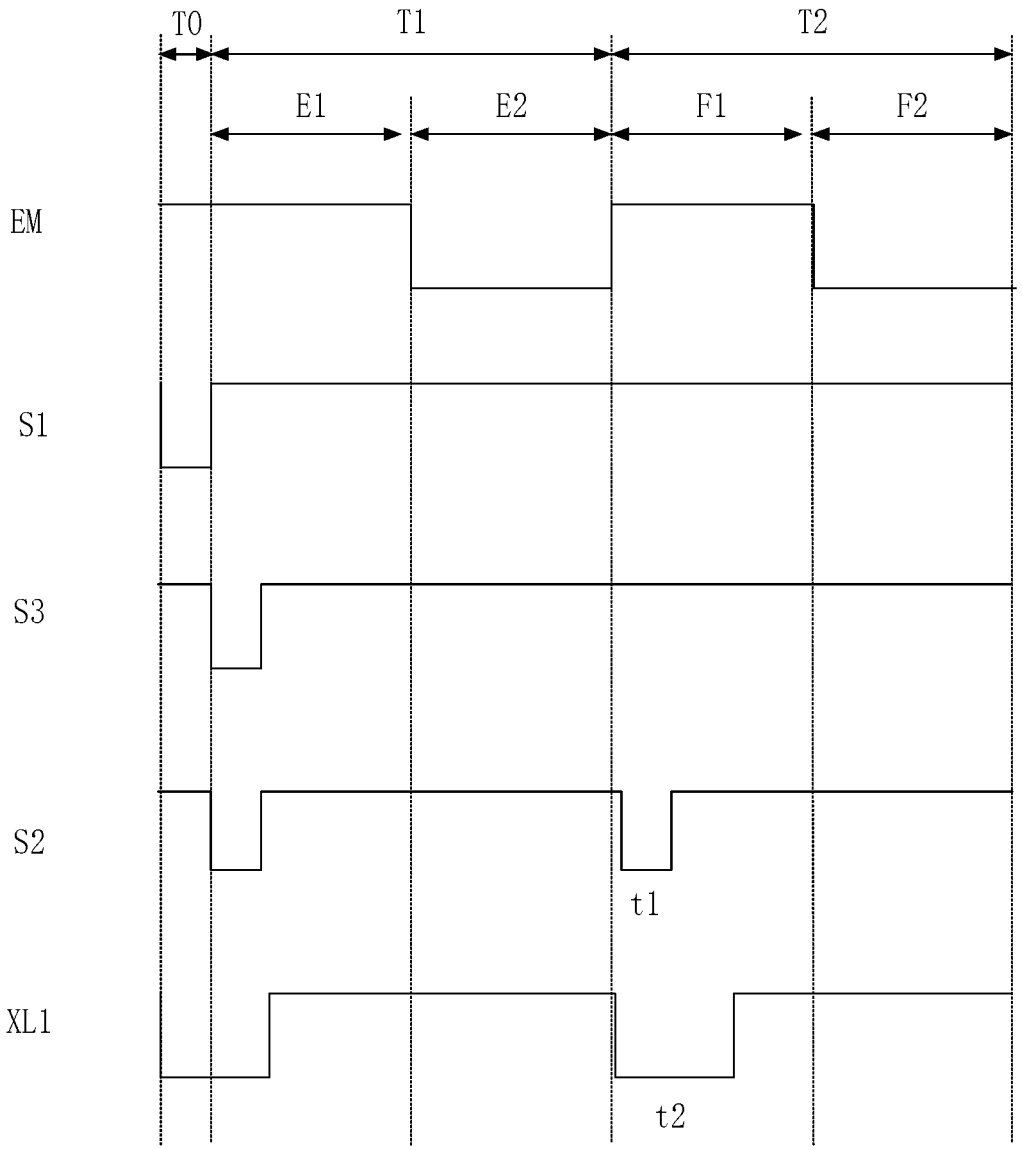
FIG. 10 is an operating timing sequence of the pixel driving circuit shown in FIG. 9 according to an embodiment of the present disclosure.

FIG. 10 is an operating timing sequence of the pixel driving circuit shown in FIG. 9 according to an embodiment of the present disclosure.

As shown in FIG. 10, in an embodiment of the present disclosure, a turn-on period t1 of the data voltage writing module 05 controlled by a signal of the second scan line S2 is within a period t2 in which the first signal line XL1 transmits a first voltage signal.

In some embodiments, during the correcting stage F1, when the data voltage writing module 05 is turned on, the first signal line XL1 transmits the first voltage signal, the coupling module 03 adjusts a potential of the control terminal 13 of the driving module 01 to be the first coupling voltage, and controls the driving module 01 to be turned on. Therefore, it is ensured that the data voltage Vdata can be transmitted to the output terminal 12 of the driving module 01 through the driving module 01 turned on, and the bias state of the driving transistor Md in the driving module 01 is corrected.

An operation process of the pixel driving circuit shown in FIG. 9 will be described below with reference to FIG. 9 and FIG. 10.

For example, in the following description, the first transistor M1, the second transistor M2, the third transistor M3, the fourth transistor M4, the fifth transistor M5, the sixth transistor M6 and the seventh transistor M7 are P-type transistors, and the first signal line XL1 is electrically connected to the gate of the first transistor M1. In another embodiment, any one of the above transistors can be an N-type transistor.

During the first reset stage T0, the first scan line S1 transmits a turn-on signal, i.e., a low level signal, and the first signal line XL1 transmits a turn-on signal, i.e., a low level signal, the first transistor M1 is turned on, and the second transistor M2 is turned on. The second scan line S2 transmits a turn-off signal, i.e., a high level signal, and the third transistor M3 and the fourth transistor M4 are turned off. The third scan line S3 transmits a turn-off signal, i.e., a high level signal, and the fifth transistor M5 is turned off. The signal line EM transmits a turn-off signal, i.e., a high level signal, and the sixth transistor M6 and the seventh transistor M7 are turned off. Synchronously, the first resetting line SL1 transmits the first resetting voltage Vref1, and the first resetting voltage Vref1 is transmitted to the gate of the driving transistor Md through the first transistor M1 and the second transistor M2 that are turned on to reset the driving transistor Md.

Since the first resetting voltage Vref1 is transmitted to the gate of the driving transistor Md, the low level signal of the first signal line XL1 doesnot affect the potential of the gate of the driving transistor Md. That is, during the first reset stage T0, the first voltage signal of the first signal line XL1 is only used as the turn-on signal of the first transistor M1.

During the data writing stage E1 of the first light-emitting stage T1, the first scan line S1 transmits a turn-off signal, that is, a high level signal, and the first signal line XL1 transmits a turn-off signal, that is, a high level signal, and the first transistor M1 and the second transistor M2 are turned off. The second scan line S2 transmits a turn-on signal, that is, a low level signal, the third transistor M3 and the fourth transistor M4 are turned on. The third scan line S3 transmits a turn-on signal, that is, a low level signal, the fifth transistor M5 is turned on. The light-emitting control signal line EM transmits a turn-off signal, that is, a high level signal. The sixth transistor M6 and the seventh transistor M7 are turned off Synchronously, the data voltage signal line DL1 transmits a data voltage Vdata. During an initial stage of the data writing stage E1, a potential of the gate of the driving transistor Md is the first resetting voltage Vref1, and a potential of the first electrode of the driving transistor Md is the data voltage signal Vdata. The potential difference between the first electrode and the gate of the driving transistor Md is (Vdata-Vref1), which is greater than 0. Therefore, the driving transistor Md is turned on, and the data voltage Vdata is transmitted to the gate of the driving transistor Md through the t driving transistor Md turned on and the five transistors M5 turned-on, so that the potential of the gate of the driving transistor Md gradually increases. When a potential of the gate of the driving transistor Md is equal to (Vdata−|Vth|), the driving transistor Md is turned off. At this time, during the data writing stage E1, a potential of the gate of the driving transistor Md is maintained at (Vdata−|Vth|), where, Vth is a threshold voltage of the driving transistor Md.

Synchronously, a first resetting voltage Vref1 is transmitted by the first resetting line SL1 to reset the input terminal 41 of the light-emitting module 04 through the fourth transistor M4 that is turned on. In an embodiment, the light-emitting module 04 includes an organic light-emitting diode, and the first resetting voltage Vref1 resets the anode of the organic light-emitting diode through the fourth transistor M4 that is turned on.

During the light-emitting stage E2 of the first light-emitting stage T1, the first scan line S1, the first signal line XL1, the second scan line S2 and the third scan line S3 transmit a turn-off signal, that is, a high level signal, and the first transistor M1, the second transistor M2, the third transistor M3, the fourth transistor M4, and the fifth transistor M5 are turned off. The light-emitting control signal line EM transmits a turn-on signal, and the sixth transistor M6 and the seventh transistor M7 are turned on. Synchronously, the power voltage signal line DL2 transmits a power voltage VDD, that is, a potential of the first electrode of the driving transistor Md is the power voltage VDD. Since the potential of the power voltage VDD is greater than the data voltage Vdata, the driving transistor Md generates a light-emitting driving current and transmits it to the input terminal 41 of the light-emitting module 04 through the seventh transistor M7 to control the light-emitting module 04 to emit light.

During the correcting stage F1 of the second light-emitting stage T2, the first signal line XL1 transmits a first voltage signal, that is, a low level signal, the first scan line S1 transmits a turn-off signal, that is, a high level signal, the first transistor M1 is turned on, and the first transistor M1 is turned on. The second transistor M2 is turned off. The second scan line S2 transmits a turn-on signal, that is, a low level signal, the third transistor M3 and the fourth transistor M4 are turned on. The third scan line S3 transmits a turn-off signal, that is, a high level signal, the fifth transistor M5 is turned off. The light-emitting control signal line EM transmits a turn-off signal, that is, a high level signal, and the sixth transistor M6 and the seventh transistor M7 are turned off.

Due to the coupling effect of the first capacitor C1, the gate of the driving transistor Md generates a first coupling voltage, a source potential of the driving transistor Md is the data voltage signal Vdata, and a potential difference between the first electrode and the gate of the driving transistor Md is greater than 0. Therefore, the driving transistor Md is turned on, the data voltage Vdata is transmitted to the second electrode of the driving transistor Md through the driving transistor Md turned on, and the first electrode plate of the second capacitor C2 is charged to generate a current flowing through the driving transistor Md. Thus, the bias state of the driving transistor Md is corrected.

During the light-emitting stage F2 of the second light-emitting stage T2, the first signal line XL1 transmits a second voltage signal, i.e., a high level signal. The first scan line S1, the second scan line S2 and the third scan line S3 each transmit a turn-off signal, i.e., a high level signal, the first transistor M1, the second transistor M2, the third transistor M3, the fourth transistor M4, and the fifth transistor M5 each are turned off. The light-emitting control signal line EM transmits a turn-on signal, i.e., a low level signal, the sixth transistor M6 and the seventh transistor M7 are turned on.

Due to coupling effect of the first capacitor C1, the gate of the driving transistor Md generates a second coupling voltage which equals to the potential of the gate of the driving transistor Md when the data writing stage E1 is completed. Synchronously, the power voltage signal line DL2 transmits a power voltage VDD, that is, the potential of the first electrode of the driving transistor Md is the power voltage VDD. Since the potential of the power voltage VDD is greater than that of the data voltage Vdata, the driving transistor Md generates a light-emitting driving current and transmits it to the input terminal 41 of the light-emitting module 04 through the seventh transistor M7 to control the light-emitting module 04 to emit light.

In an embodiment of the present disclosure, during the correcting stage F1 of the second light-emitting stage T2, the bias state of the driving transistor Md in the driving module 01 is corrected, and a bias state difference of the driving transistor Md between the second light-emitting stage T2 and the first light-emitting stage T1 is reduced. Therefore, a speed difference of the current ramping of the light-emitting module 04 between the first light-emitting stage T1 and the second light-emitting stage T2 is reduced, and then a brightness difference of the display panel between the first light-emitting stage T1 and the second light-emitting stage T2 is reduced, thereby improving the display effect of the display panel.

Figure 11:
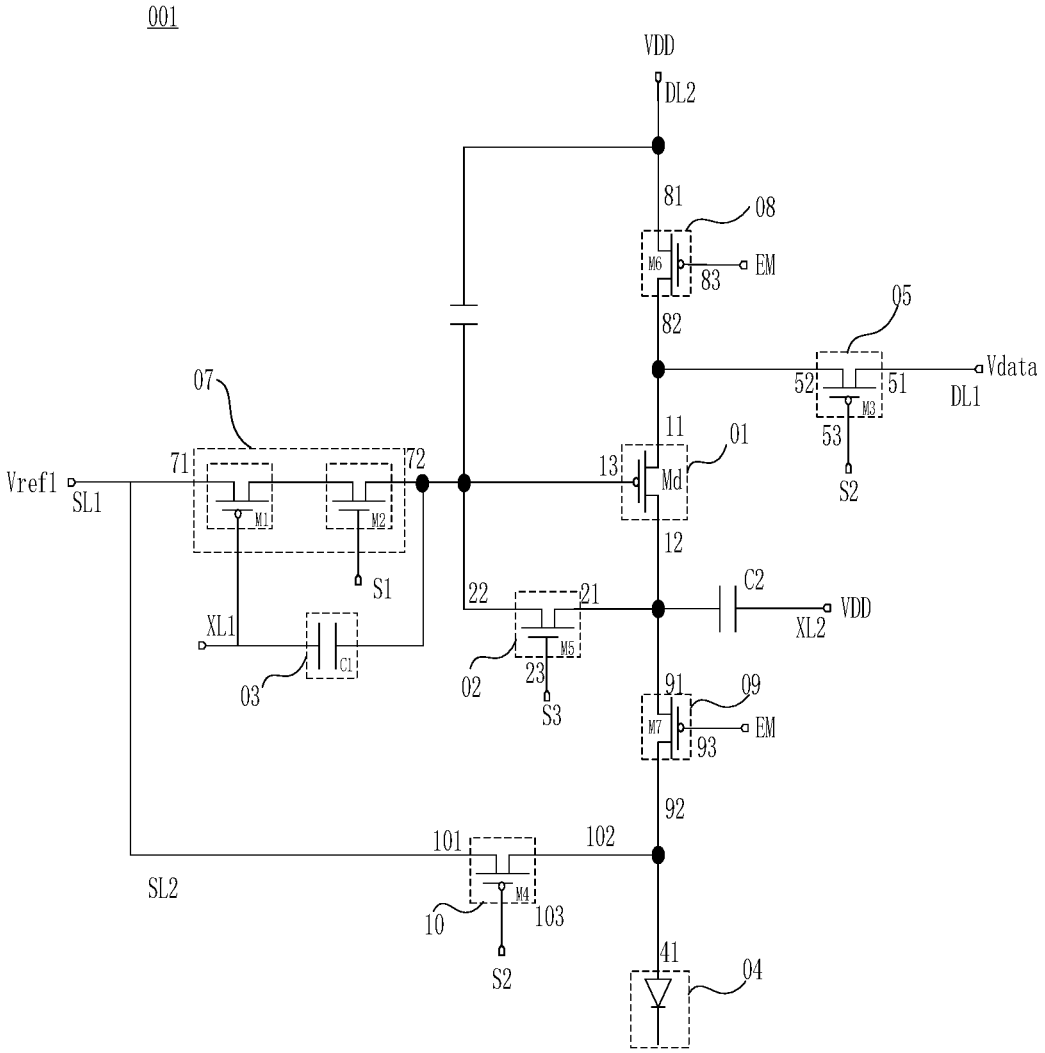
FIG. 11 is a schematic diagram of a pixel driving circuit according to another embodiment of the present disclosure.
Figure 12:
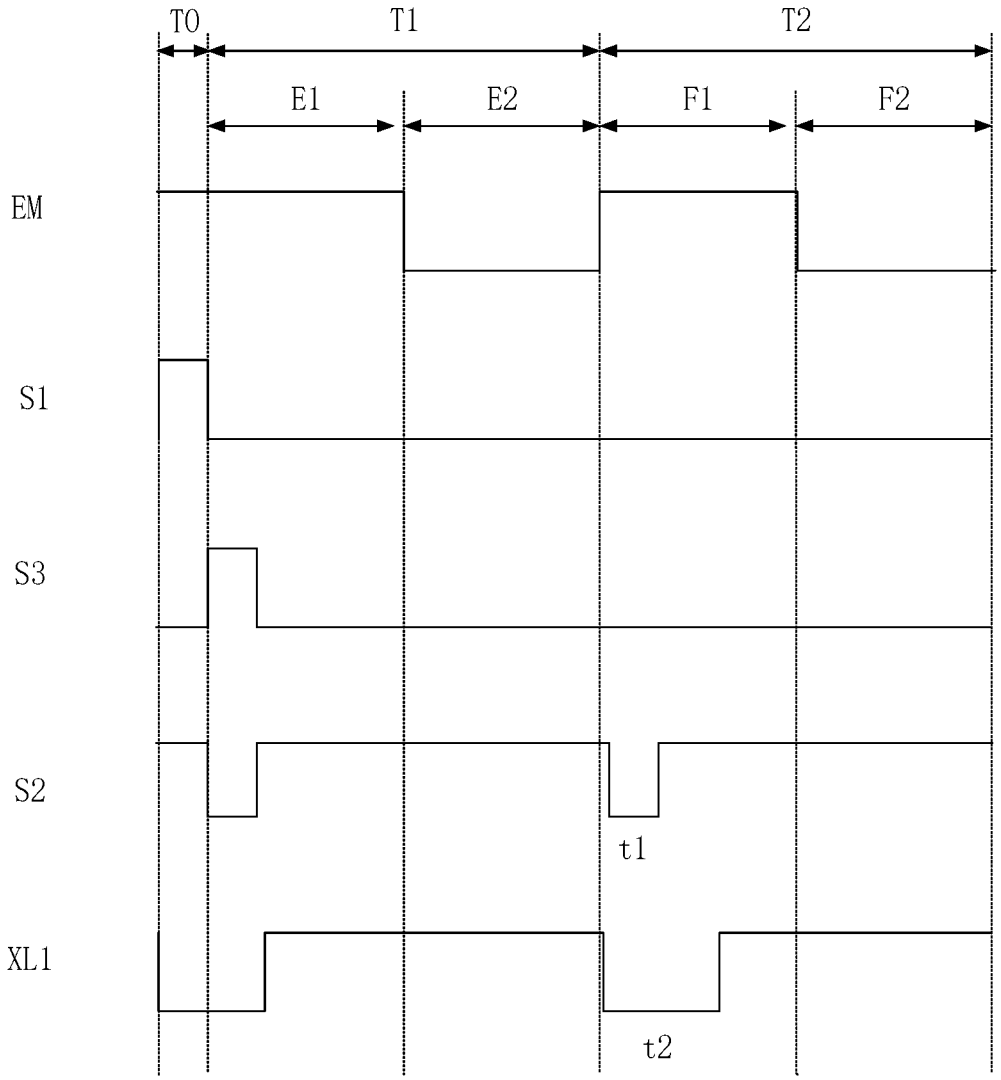
FIG. 12 is an operating timing sequence of the pixel driving circuit shown in FIG. 11 according to an embodiment of the present disclosure.

FIG. 11 is a schematic diagram of a pixel driving circuit according to another embodiment of the present disclosure, and FIG. 12 is an operating timing sequence of the pixel driving circuit shown in FIG. 11 according to an embodiment of the present disclosure.

A difference between the pixel driving circuit 001 shown in FIG. 11 and the pixel driving circuit 001 shown in FIG. 9 only lies in that the second transistor M2 and the fifth transistor M5 are N-type transistors including metal oxide active layers.

Compared with the sequence shown in FIG. 10, a timing sequence change corresponding to the pixel driving circuit 001 shown in FIG. 12 lies in that a turn-on signal transmitted by the first scan line S1 and a turn-on signal transmitted by the third scan line S3 are high level signals, and a turn-off signal transmitted by the first scan line S1 and a turn-off signal transmitted by the third scan line S3 is a low level signal.

Figure 13:
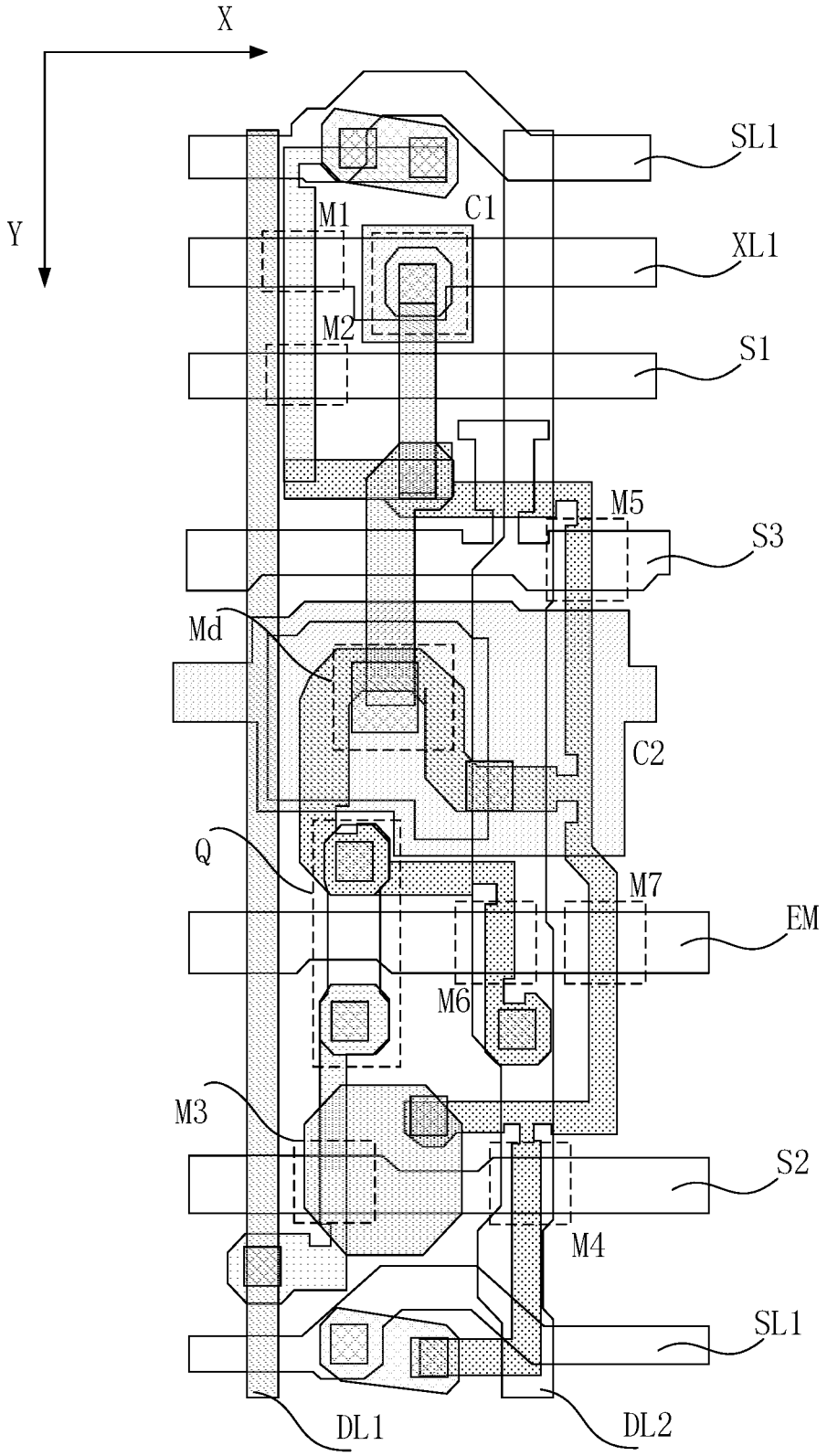
FIG. 13 is a schematic diagram of a layout of pixel driving circuits according to an embodiment of the present disclosure.

FIG. 13 is a schematic diagram of a layout of pixel driving circuits according to an embodiment of the present disclosure.

As shown in FIG. 13, in an embodiment of the present disclosure, a first signal line XL1 and a first scan line S1 each extend along a first direction X, and a first transistor M1 and a second transistor M2 are located at a same side of the driving module 01. That is, the first transistor M1 and the second transistor M2 are located at a same side of the driving transistor Md.

The semiconductor layers of the first transistor M1 and the second transistor M2 are connected to each other, which can reduce the bending degree of the semiconductor layers of the first transistor M1 and the second transistor M2, and therefore facilitate the preparation of the first transistor M1 and the second transistor M2.

In an embodiment of the present disclosure, the first electrode plate of the first capacitor C1 is provided in the same layer as the gate of at least one of the first transistor M1 or the second transistor M2. A layer where the second electrode plate of the first capacitor C1 is located is located between a layer where the first electrode plate of the first capacitor C1 is located and a layer where the power voltage signal line DL2 is located.

The first electrode plate of the first capacitor C1 can be prepared synchronously with the gate of at least one of the first transistor M1 or the second transistor M2.

Referring to FIG. 11, in an embodiment of the present disclosure, the second scan line S2 extends along the first direction X, and the third transistor M3 and the fourth transistor M4 are located at a same side of the driving module 01. That is, the third transistor M3 and the fourth transistor M4 are located at a same side of the driving transistor Md.

The third transistor M3 and the fourth transistor are electrically connected to the same second scan line S2, which can reduce the bending degree of the second scan line S2 and facilitate its preparation.

The fifth transistor M5 and the third transistor M3 are located at different sides of the driving module 01 along the second direction Y. That is, the fifth transistor M5 and the third transistor M3 are located at different sides of the driving transistor Md along the second direction Y.

The second direction Y intersects with an extending direction of the second scan line S2. That is, the second direction Y intersects with the first direction X.

In an embodiment of the present disclosure, the fifth transistor M5 and the third transistor M3 are respectively electrically connected to two electrodes of the driving transistor Md, and the fifth transistor M5 and the third transistor M3 are arranged at different sides of the driving transistor Md, which can reduce the bending degree of the transistor M5 or the third transistor M3 and facilitate their preparation.

The fifth transistor M5 can have a double-gate structure or a single gate structure.

In an embodiment of the present disclosure, referring to FIG. 11, the light-emitting control signal line EM extends along the first direction X. Along the second direction Y intersecting with the first direction X, the third transistor M3 is located at a side of the light-emitting control signal line EM away from the driving module 01.

The second electrode of the third transistor M3 is electrically connected to the input terminal of the driving module 01 through a connection electrode Q, and the connection electrode Q and the light-emitting control signal line EM overlap with each other and are located in different layers.

That is, along the second direction Y, the third transistor M3 is located at a side of the light-emitting control signal line EM away from the driving transistor Md, and the second electrode of the third transistor M3 is connected to the driving transistor Md through a connection electrode Q, and the connection electrode Q crosses the light-emitting control signal line EM and is provided in a different layer from the light-emitting control signal line EM.

In an embodiment of the present disclosure, the connection electrode Q and the light-emitting control signal line EM does not affect each other during preparation thereof.

Figure 14:
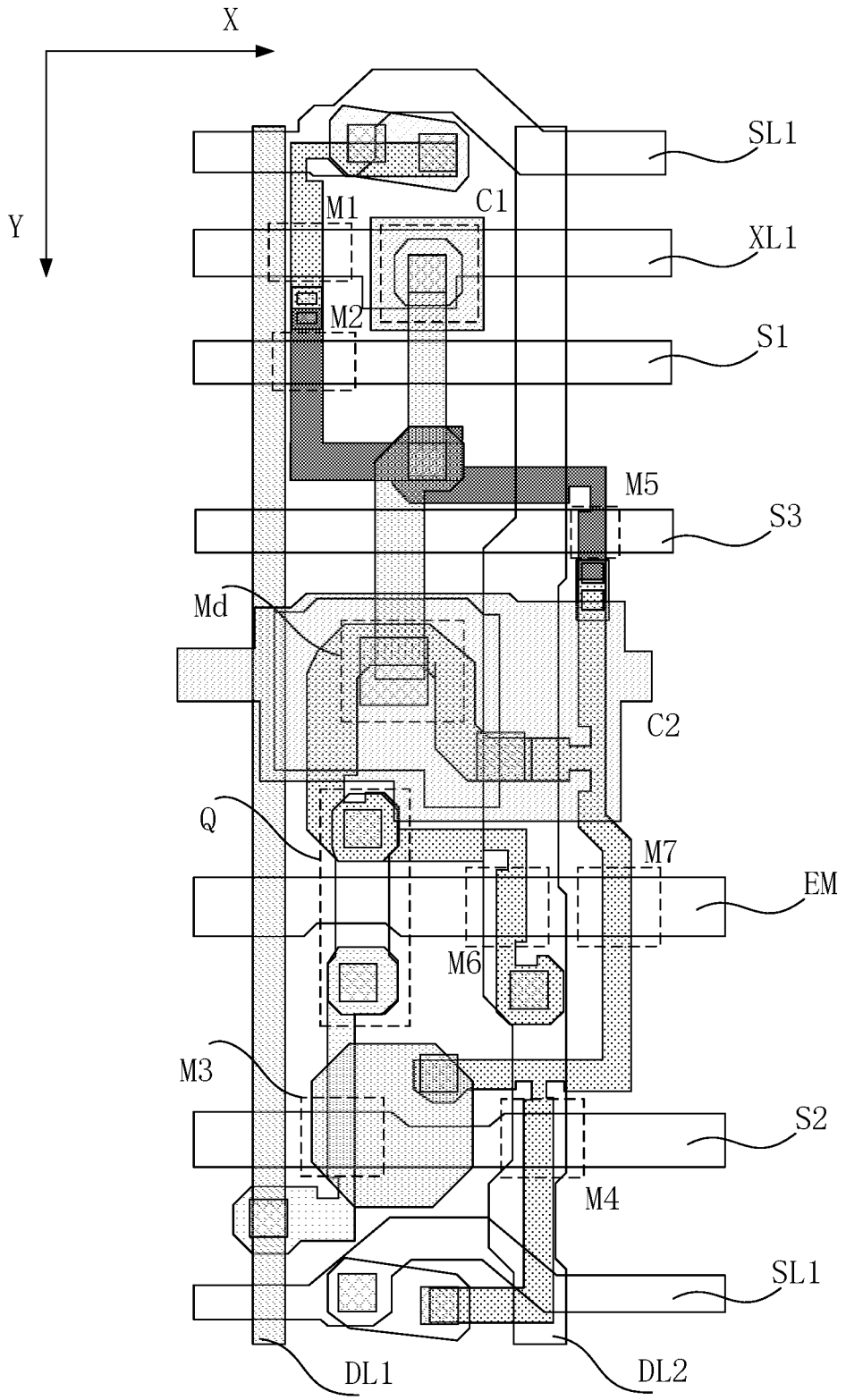
FIG. 14 is a schematic diagram of a layout of pixel driving circuits according to another embodiment of the present disclosure.

FIG. 14 is a schematic diagram of a layout of pixel driving circuits according to another embodiment of the present disclosure.

A difference between the layout of the pixel driving circuits shown in FIG. 14 and the layout of the pixel driving circuits shown in FIG. 13 lies in that, the second transistor M2 and the fifth transistor M5 each include a metal oxide the semiconductor layer. The metal oxide semiconductor layer is connected to a polysilicon semiconductor layer through via holes.

In an embodiment of the present disclosure, a method for driving a pixel driving circuit is provided, which is configured to drive the pixel driving circuit 001 provided in the above-mentioned embodiments. The structure of the pixel driving circuit 001 can refer to FIG. 1, FIG. 4, FIG. 6 to FIG. 9, and FIG. 11.

The pixel driving circuit 001 includes a driving module 01, a threshold voltage capturing module 02 and a coupling module 03. The driving module 01 is configured to generate a light-emitting driving current. An input terminal 21 of the threshold voltage capturing module 02 is electrically connected to an output terminal 12 of the driving module 01, and an output terminal 22 of the threshold voltage capturing module 02 is electrically connected to a control terminal 13 of the driving module 01. An input terminal 31 of the coupling module 03 is electrically connected to a first signal line XL1, and an output terminal 32 of the coupling module 03 is electrically connected to the control terminal 13 of the driving module 01.

An operating sequence of the pixel driving circuit 001 includes multiple operating cycles. One operating cycle includes a first light-emitting stage T1 and a second light-emitting stage T2 after the first light-emitting stage T1. The first light-emitting stage T1 includes a data writing stage E1 and a light-emitting stage E2 after the data writing stage E1. The second light-emitting stage T2 includes a correcting stage F1 and a light-emitting stage F2 after the correcting stage F1.

The operating sequences of the pixel driving circuits 001 can refer to FIG. 5, FIG. 10, and FIG. 12. The method for driving the pixel driving circuit can be understood in conjunction with the operating process of the pixel driving circuit 001 in the above embodiments.

Figure 15:
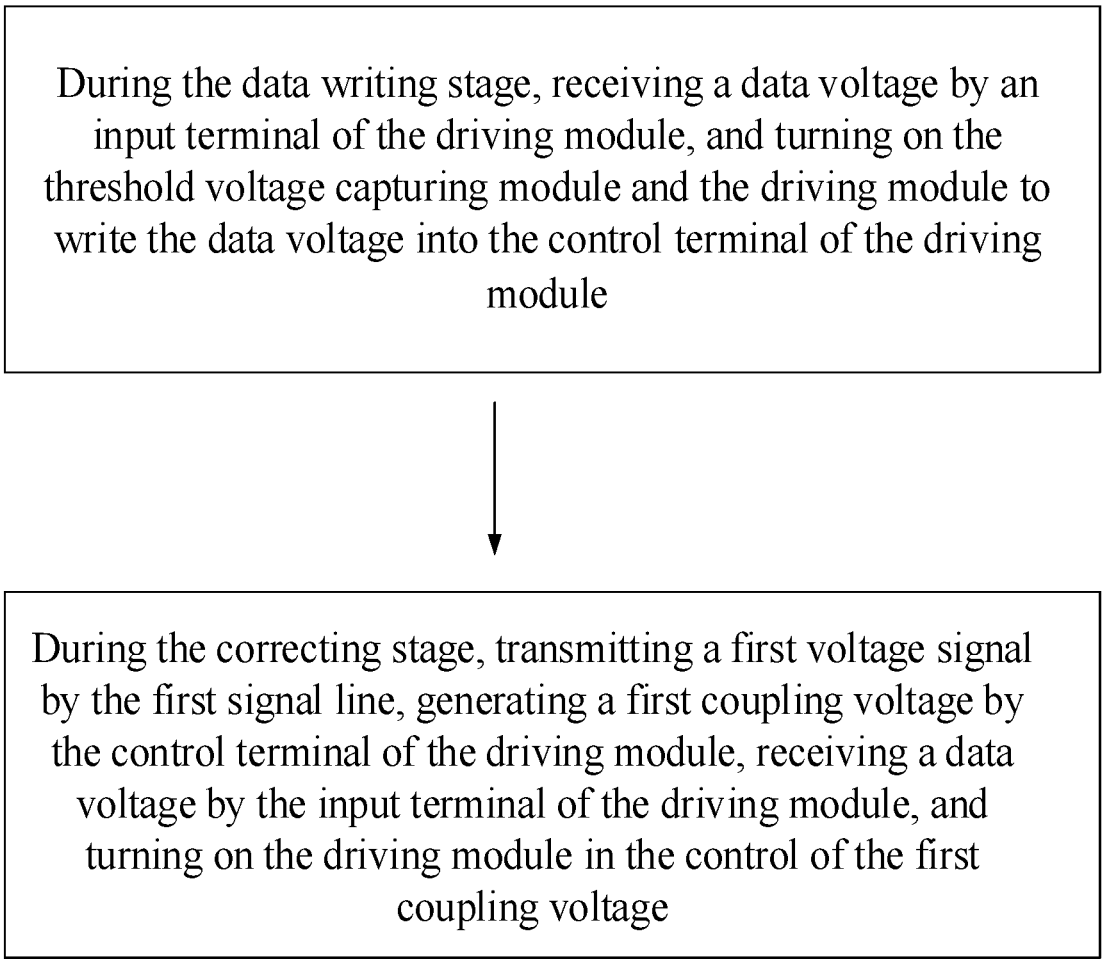
FIG. 15 is a flowchart of a method for driving a pixel driving circuit according to an embodiment of the present disclosure.

FIG. 15 is a flowchart of a method for driving a pixel driving circuit according to an embodiment of the present disclosure.

As shown in FIG. 15, the method for driving the pixel driving circuit includes steps S1 and S2.

At step S1, during the data writing stage E1, an input terminal 11 of the driving module 01 receives a data voltage Vdata, and the threshold voltage capturing module 02 and the driving module 01 are turned on to write the data voltage Vdata to the control terminal 13 of the driving module 01.

At step S2, during the correcting stage F1, the first signal line XL1 transmits a first voltage signal, the control terminal 13 of the driving module 01 generates the first coupling voltage, the input terminal 11 of the driving module 01 receives a data voltage Vdata, and the first coupling voltage control the driving module 01 to be turned on.

In the method for driving the pixel driving circuit provided by the embodiments of the present disclosure, when the pixel driving circuit 001 is operated during the correcting stage F1 of the second light-emitting stage T2, the driving module 01 is controlled to be turned on by a coupling action of the coupling module 03, and the data voltage Vdata can be transmitted to the output terminal 12 of the driving module 01 through the driving module 01 turned on, so that a bias state of the driving transistor Md in the driving module 01 is corrected. Further, a bias state difference of the driving transistor Md between the second light-emitting stage T2 and the first light-emitting stage T1 is reduced, so that a speed difference of the current ramping of the light-emitting module 04 between the first light-emitting stage T1 and the second light-emitting stage T2 is reduced, thereby improving the display effect of the display panel.

Figure 16:
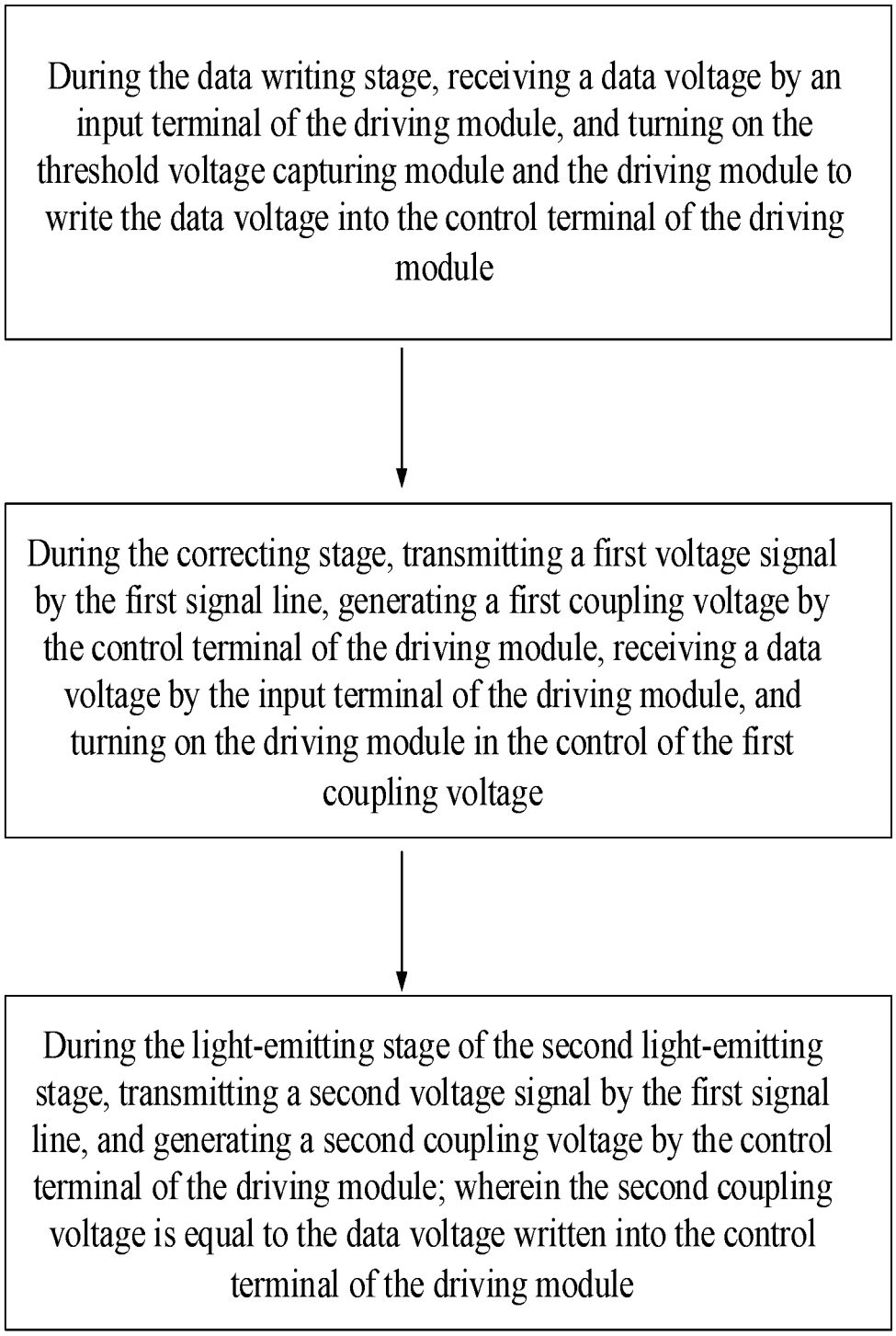
FIG. 16 is a flowchart of a method for driving a pixel driving circuit according to another embodiment of the present disclosure.

FIG. 16 is a flowchart of a method for driving a pixel driving circuit according to another embodiment of the present disclosure.

As shown in FIG. 16, in an embodiment of the present disclosure, the method for driving the pixel driving circuit further includes step S3.

At step S3, during the light-emitting stage F2 of the second light-emitting stage T2, the first signal line XL1 transmits a second voltage signal, and the control terminal 13 of the driving module 01 generates a second coupling voltage. The second coupling voltage is equal to the data voltage written into the control terminal 13 of the driving module 01.

The embodiments of the present disclosure ensure that during the light-emitting stage E2 of the first light-emitting stage T1 and the light-emitting stage F2 of the second light-emitting stage T2, the driving transistor Md generates the light-emitting driving current with the same data voltage Vdata, so that a speed difference of the current ramping of the light-emitting module 04 between the first light-emitting stage T1 and the second light-emitting stage T2 is reduced, and then a brightness difference of the display panel between the first light-emitting stage T1 and the second light-emitting stage T2 is reduced, thereby improving the display effect of the display panel.

The step S2 where, during the correcting stage F1, the first signal line XL1 transmits the first voltage signal, and the control terminal 13 of the driving module 01 generates a first coupling voltage, the input terminal 11 of the driving module 01 receives the data voltage Vdata, and the first coupling voltage controls the driving module 01 to be turned on, can includes turning off the threshold voltage capturing module 02 during the correcting stage F1.

Therefore, it is ensured that the data voltage Vdata cannot be written into the input terminal 13 of the driving module 01 during the correcting stage F1, thereby avoiding affecting accuracy of the light-emitting driving current during the light-emitting stage F2 of the second light-emitting stage T2.

Figure 17:
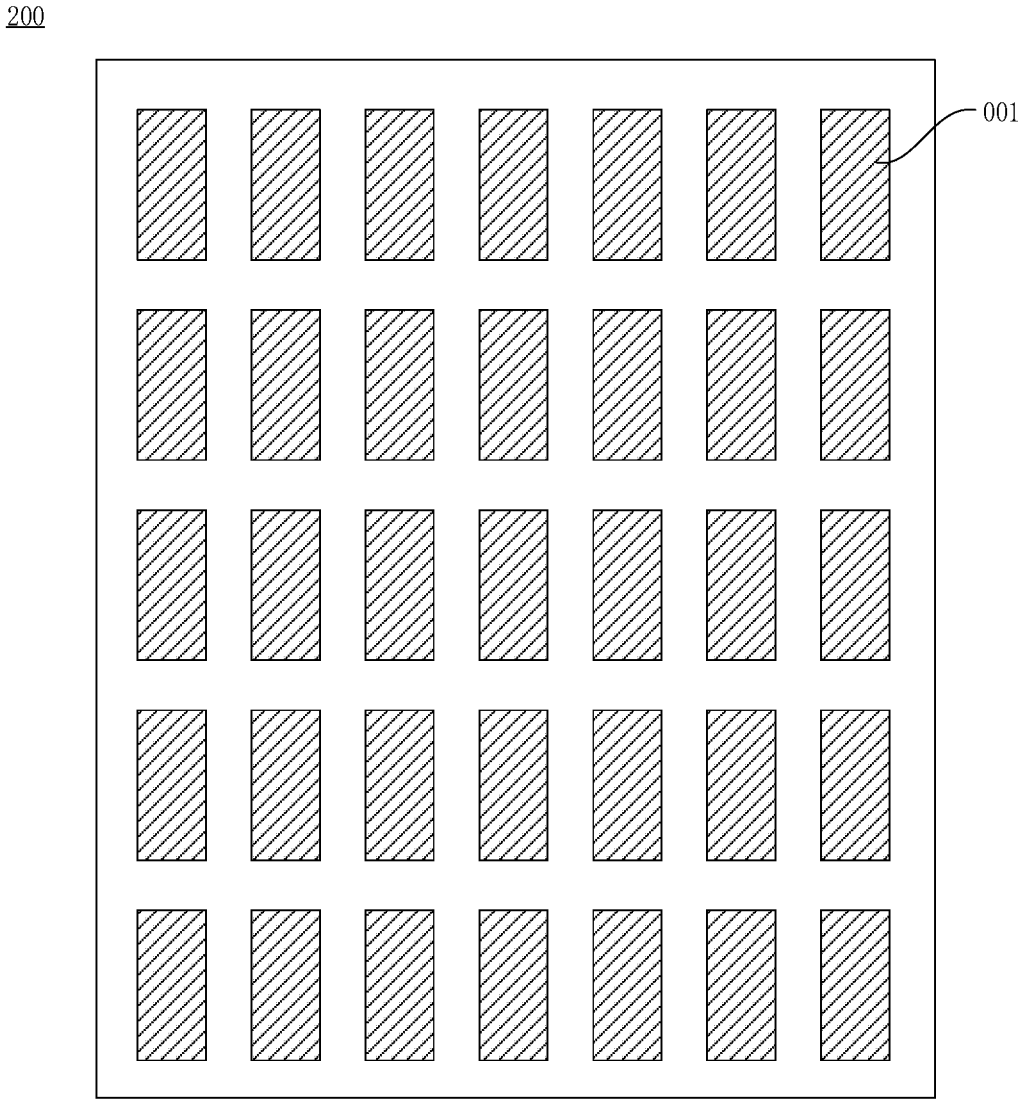
FIG. 17 is a schematic diagram of a display panel according to an embodiment of the present disclosure.

FIG. 17 is a schematic diagram of a display panel according to an embodiment of the present disclosure.

In an embodiment of the present disclosure, a display panel 200 is provided. As shown in FIG. 17, the display panel 200 includes multiple pixel driving circuits 001 provided in the embodiments mentioned above. Multiple pixel driving circuits 001 can be arranged in an array along a row direction and a column direction in the display panel 200.

In the display panel 200, when the pixel driving circuits 001 operate during the correcting stage F1 of the second light-emitting stage T2, the driving module 01 is controlled to be turned on by a coupling action of the coupling module 03, and the data voltage Vdata is transmitted to the output terminal 12 of the driving module 01, so that a bias state of the driving transistor Md in the driving module 01 is corrected. Further, a bias state difference of the driving transistor Md between the second light-emitting stage T2 and the first light-emitting stage T1 is reduced, so that a speed difference of the current ramping of the light-emitting module 04 between the first light-emitting stage T1 and the second light-emitting stage T2 is reduced, thereby improving the display effect of the display panel.

The above are merely some embodiments of the present disclosure, which, as mentioned above, are not intended to limit the present disclosure. Within the principles of the present disclosure, any modification, equivalent substitution, improvement shall fall into the protection scope of the present disclosure.

What is claimed is:

1. A pixel driving circuit, comprising:

a driving module configured to generate a light-emitting driving current;

a threshold voltage capturing module, wherein the threshold voltage capturing module comprises an input terminal electrically connected to an output terminal of the driving module and an output terminal electrically connected to a control terminal of the driving module, and the threshold voltage capturing module is configured to control an electrical connection state between the control terminal of the driving module and the output terminal of the driving module; and a coupling module, wherein the coupling module comprises an input terminal electrically connected to a first signal line and an output terminal electrically connected to the control terminal of the driving module, and the coupling module is configured to adjust a potential of the control terminal of the driving module based on a signal of the first signal line, wherein the threshold voltage capturing module controls the output terminal of the driving module to be disconnected from the control terminal of the driving module when the coupling module controls the driving module to be turned on by adjusting the potential of the control terminal of the driving module.

2. The pixel driving circuit according to claim 1, wherein the first signal line is configured to transmit a first voltage signal, the coupling module is configured to adjust the potential of the control terminal of the driving module to be a first coupling voltage based on the first voltage signal, and the driving module is controlled to be turned on by the first coupling voltage; and the first signal line is configured to transmit a second voltage signal, the coupling module is configured to adjust the potential of the control terminal of the driving module to be a second coupling voltage based on the second voltage signal, and the second coupling voltage is equal to the data voltage written to the control terminal of the driving module.

3. The pixel driving circuit according to claim 2, wherein the coupling module comprises a first capacitor, wherein the first capacitor comprises a first electrode plate electrically connected to the first signal line and a second electrode plate electrically connected to the control terminal of the driving module.

4. The pixel driving circuit according to claim 3, further comprising:

a first reset module, wherein the first reset module comprises an input terminal electrically connected to a first resetting line and an output terminal electrically connected to the control terminal of the driving module, and the first reset module is configured to reset the control terminal of the driving module.

5. The pixel driving circuit according to claim 4, further comprising:

a data voltage writing module comprising an input terminal electrically connected to a data voltage signal line, an output terminal electrically connected to an input terminal of the driving module, and a control terminal electrically connected to a second scan line, wherein the data voltage writing module is configured to write a data voltage to the input terminal of the driving module.

6. The pixel driving circuit according to claim 5, further comprising:

a light-emitting module; and a second reset module comprising an input terminal electrically connected to a second resetting line, an output terminal electrically connected to the light-emitting module, and a control terminal electrically connected to the second scan line, wherein the second reset module and the data voltage writing module that are controlled by a signal of the second scan line have a same on-off state.

7. The pixel driving circuit according to claim 6, wherein the data voltage writing module comprises a third transistor, wherein the third transistor comprises a first electrode electrically connected to the data voltage signal line, a second electrode electrically connected to the input terminal of the driving module, and a gate electrically connected to the second scan line;

the second reset module comprises a fourth transistor, wherein the fourth transistor comprises a first electrode electrically connected to the second resetting line, a second electrode electrically connected to an input terminal of the light-emitting module, and a gate electrically connected to the second scan line; and the third transistor and the fourth transistor have a same channel type.

8. The pixel driving circuit according to claim 7, wherein the threshold voltage capturing module comprises a control terminal electrically connected to a third scan line; and a signal of the third scan line controls an on-off state of the threshold voltage capturing module.

9. The pixel driving circuit according to claim 8, wherein the threshold voltage capturing module comprises a fifth transistor, wherein the fifth transistor comprises a first electrode electrically connected to the output terminal of the driving module, a second electrode electrically connected to the control terminal of the driving module, and a gate electrically connected to the third scan line.

10. The pixel driving circuit according to claim 9, wherein the fifth transistor and the third transistor are located at different sides of the driving module along a second direction, and the second direction intersects with an extending direction of the second scan line.

11. The pixel driving circuit according to claim 9, wherein the fifth transistor comprises a metal oxide active layer.

12. The pixel driving circuit according to claim 7, further comprising:

a sixth transistor comprising a first electrode electrically connected to a power voltage signal line, a second electrode electrically connected to the input terminal of the driving module, and a gate electrically connected to a light-emitting control signal line; and a seventh transistor comprising a first electrode electrically connected to the output terminal of the driving module, a second electrode electrically connected to a light-emitting module, and a gate electrically connected to the light-emitting control signal line, wherein the sixth transistor and the seventh transistor have a same channel type.

13. The pixel driving circuit according to claim 12, wherein the light-emitting control signal line extends along a first direction;

the third transistor is located at a side of the light-emitting control signal line away from the driving module along a second direction intersecting with the first direction; and the second electrode of the third transistor is electrically connected to the input terminal of the driving module through a connection electrode, and the connection electrode and the light-emitting control signal line overlaps with each other and are located in different layers.

14. The pixel driving circuit according to claim 7, wherein the second scan line extends along a first direction, and the third transistor and the fourth transistor are located at a same side of the driving module.

15. The pixel driving circuit according to claim 6, wherein the first resetting line is electrically connected to the second resetting line.

16. The pixel driving circuit according to claim 5, wherein a moment when a signal of the second scan line controls the data voltage writing module to be turned on is within a duration during which the first signal line transmits the first voltage signal.

17. The pixel driving circuit according to claim 4, wherein the first reset module comprises a first transistor and a second transistor, wherein the first transistor comprises a first electrode electrically connected to the first resetting line and a second electrode electrically connected to a first electrode of the second transistor, and the second transistor further comprises a second electrode electrically connected to the control terminal of the driving module; and a gate of one of the first transistor and the second transistor is electrically connected to the first signal line, and a gate of another one of the first transistor and the second transistor is electrically connected to a first scan line.

18. The pixel driving circuit according to claim 17, wherein the gate of the one of the first transistor and the second transistor that is electrically connected to the first signal line receives a same signal as a signal received by the first electrode plate of the first capacitor.

19. The pixel driving circuit according to claim 17, wherein at least one of the first transistor or the second transistor comprises a metal oxide active layer.

20. The pixel driving circuit according to claim 17, wherein the first signal line and the first scan line each extend along a first direction, and the first transistor and the second transistor are located at a same side of the driving module.

21. The pixel driving circuit according to claim 17, wherein the first electrode plate of the first capacitor is located in a same layer as the gate of at least one of the first transistor or the second transistor, a layer where the second electrode plate of the first capacitor is located is located between a layer where the first electrode plate of the first capacitor is located and a layer where a power voltage signal line is located.

22. The pixel driving circuit according to claim 1, further comprising:

a second capacitor comprising a first electrode plate electrically connected to the output terminal of the driving module and a second electrode plate electrically connected to a fixed-potential signal line.

23. The pixel driving circuit according to claim 22, wherein the fixed-potential signal line is electrically connected to a power voltage signal line.

24. A pixel driving circuit, wherein an operating sequence of the pixel driving circuit comprises a plurality of operating cycles, wherein each of the plurality of operating cycles comprises a first light-emitting stage and a second light-emitting stage after the first light-emitting stage, wherein the first light-emitting stage comprises a data writing stage and a light-emitting stage after the data writing stage, and the second light-emitting stage comprises a correcting stage and a light-emitting stage after the correcting stage; and wherein the pixel driving circuit comprises:

a driving module configured to generate a light-emitting driving current during the light-emitting stage, a threshold voltage capturing module electrically connected to the driving module and configured to be turned on and to write a data voltage to a control terminal of the driving module during the data writing stage, and a coupling module electrically connected to the control terminal of the driving module and configured to adjust a coupling voltage of the control terminal of the driving module during the correcting stage and the light-emitting stage.

25. The pixel driving circuit according to claim 24, further comprising:

a data voltage writing module electrically connected to the driving module and configured to write a data voltage to an input terminal of the driving module during the data writing stage and the correcting stage.

26. The pixel driving circuit according to claim 25, further comprising:

a current-leakage module comprising a terminal electrically connected to an output terminal of the driving module, wherein the current-leakage module is configured to cause the data voltage written to the input terminal of the driving module to generate a current flowing through the driving module during the correcting stage.

27. The pixel driving circuit according to claim 25, further comprising:

a first reset module reset module electrically connected to the control terminal of the driving module and configured to reset the control terminal of the driving module during the first reset stage, wherein each of the plurality of operating cycles further comprises a first reset stage prior to the first light-emitting stage.

28. The pixel driving circuit according to claim 24, wherein the coupling module is configured to adjust a potential of the control terminal of the driving module to be a first coupling voltage during the correcting stage to control the driving module to be turned on.

29. The pixel driving circuit according to claim 24, wherein the coupling module is further configured to adjust a potential of the control terminal of the driving module to be a second coupling voltage during the light-emitting stage of the second light-emitting stage voltage, wherein the second coupling voltage is equal to the data voltage written to the control terminal of the driving module.

30. A method for driving a pixel driving circuit, wherein the pixel driving circuit comprises:

a driving module configured to generate a light-emitting driving current;

a threshold voltage capturing module comprising an input terminal electrically connected to an output terminal of the driving module, and an output terminal electrically connected to a control terminal of the driving module; and a coupling module comprising an input terminal electrically connected to a first signal line, and an output terminal electrically connected to a control terminal of the driving module;

wherein an operating sequence of the pixel driving circuit comprises a plurality of operating cycles, wherein each of the plurality of operating cycles comprises a first light-emitting stage and a second light-emitting stage after the first light-emitting stage, wherein the first light-emitting stage comprises a data writing stage and a light-emitting stage after the data writing stage, and the second light-emitting stage comprises a correcting stage and a light-emitting stage after the correcting stage; and wherein the method comprises:

during the data writing stage, receiving a data voltage by an input terminal of the driving module, and turning on the threshold voltage capturing module and the driving module to write the data voltage to the control terminal of the driving module; and during the correcting stage, transmitting a first voltage signal by the first signal line, generating a first coupling voltage by the control terminal of the driving module, receiving a data voltage by the input terminal of the driving module, and controlling the driving module to be turned on by the first coupling voltage.

31. The method according to claim 30, further comprising:

during the light-emitting stage of the second light-emitting stage, transmitting a second voltage signal by the first signal line, and generating a second coupling voltage by the control terminal of the driving module, wherein the second coupling voltage is equal to the data voltage written to the control terminal of the driving module.

32. The method according to claim 30, wherein, during the correcting stage, transmitting the first voltage signal by the first signal line, generating the first coupling voltage by the control terminal of the driving module, receiving the data voltage by the input terminal of the driving module, and controlling the driving module to be turned on by the first coupling voltage, comprises:

during the correcting stage, turning off the threshold voltage capturing module.

* * * * *